US012807387B2

(12) United States Patent
Pack

(10) Patent No.: US 12,807,387 B2
(45) Date of Patent: Nov. 24, 2026

(54) CARD CARRIER ASSEMBLY

(71) Applicant: RIPA, LLC, Broadview, IL (US)

(72) Inventor: Shawn Pack, Broadview, IL (US)

(73) Assignee: RIPA, LLC, Broadview, IL (US)

( * ) Notice: Subject to any disclaimer, the term of this patent is extended or adjusted under 35 U.S.C. 154(b) by 0 days.

(21) Appl. No.: 19/042,815

(22) Filed: Jan. 31, 2025

(65) Prior Publication Data

US 2026/0225784 A1 Aug. 6, 2026

(51) Int. Cl.

| | |
|---|---|
| ***B65D 75/24*** | (2006.01) |
| ***B65D 5/02*** | (2006.01) |
| ***B65D 5/42*** | (2006.01) |
| ***B65D 5/54*** | (2006.01) |
| ***B65D 75/14*** | (2006.01) |
| ***B65D 75/54*** | (2006.01) |

(52) U.S. Cl.

CPC ..... *B65D 75/54* (2013.01); *B65D 5/4208* (2013.01); *B65D 5/4216* (2013.01); *B65D 5/4233* (2013.01); *B65D 5/4266* (2013.01); *B65D 5/54* (2013.01); *B65D 75/14* (2013.01); *B65D 2203/06* (2013.01); *B65D 2575/565* (2013.01)

(58) Field of Classification Search

CPC .... B65D 75/54; B65D 5/4208; B65D 5/4216; B65D 5/4233; B65D 5/4266; B65D 5/54; B65D 75/14; B65D 2203/06; B65D 2575/565

USPC ..... 206/831

See application file for complete search history.

(56) References Cited

U.S. PATENT DOCUMENTS

| | | | | |
|---|---|---|---|---|
| 4,948,034 | A * | 8/1990 | Rohloff | B42D 15/02 229/92.8 |
| 5,740,915 | A * | 4/1998 | Williams | A45C 11/182 206/39 |
| 6,315,206 | B1 * | 11/2001 | Hansen | A45C 11/182 235/487 |
| 6,732,459 | B1 * | 5/2004 | Clark | B42D 15/045 40/124.06 |
| 7,011,249 | B2 * | 3/2006 | Tang | G09F 1/04 235/486 |
| 7,275,683 | B2 * | 10/2007 | Lazarowicz | G06Q 20/10 235/487 |
| 8,256,682 | B2 * | 9/2012 | Chakiris | B42D 15/045 235/380 |
| 8,322,619 | B2 * | 12/2012 | Sullivan | G06Q 20/208 235/487 |
| 10,633,128 | B2 * | 4/2020 | Este | B65B 11/52 |

(Continued)

*Primary Examiner* — Andrew D Perreault

(74) *Attorney, Agent, or Firm* — NIXON PEABODY LLP

(57) ABSTRACT

A carrier assembly includes a front panel, first and second back panels, a card panel, and first and second minor side flaps. The front panel connects to the first and second back panels via opposing fold lines. The card panel connects to one of the second back panel, the front panel, or the first back panel. The second back panel forms a tearable section configured to be at least partially removed from a remainder of the second back panel via at least one frangible connection. The card panel includes information accessible after the tearable section is at least partially removed. The information includes predetermined or variable monetary value. The front panel, the first and second back panels, and the first and second minor side flaps are folded and attached to one or more of the other panels so as to contain the card panel.

14 Claims, 23 Drawing Sheets

(56) References Cited

U.S. PATENT DOCUMENTS

| | | | | |
|---|---|---|---|---|
| 11,111,065 | B2 * | 9/2021 | Glass | B65D 27/04 |
| 2001/0022446 | A1 * | 9/2001 | Klure | B42D 15/025 283/62 |
| 2004/0146688 | A1 * | 7/2004 | Treat | B42D 15/042 428/63 |
| 2019/0251413 | A1 * | 8/2019 | Pascua | G06K 19/06028 |

* cited by examiner

CARD CARRIER ASSEMBLY

FIELD OF THE INVENTION

The present invention relates generally to carrier assemblies. In particular, the present invention relates to a carrier assembly that is configured to securely contain an item such as a gift card therein.

BACKGROUND

Flat sheets of materials, typically referred to as blanks, have been used for many years as the starting material to form carrier assemblies. Carrier assemblies are adapted to contain and secure a product. One type of product that can be contained within a carrier assembly is a gift card. Some, if not many, of these carrier assemblies do not securely contain the gift card without a visible indication that the carrier assembly has been opened or tampered with. This is especially important in that information from gift cards contained in some carrier assemblies can be fraudulently accessed without a consumer realizing that the carrier assembly has been comprised. With this fraudulently obtained information, the amount on the gift card can be stolen/used once the card has been activated at point of purchase before the consumer has a chance to use it. This obviously renders the gift card useless to the consumer when attempting to use it in the future.

Therefore, it would be desirable to have a carrier assembly that overcomes these disadvantages, while still being easily opened by the consumer.

SUMMARY

According to aspects of the present disclosure, a carrier assembly includes a front panel, a first back panel, a second back panel, at least one card panel, a first minor side flap, and a second minor side flap. The front panel connects to the first and second back panels via opposing fold lines. The card panel connects to one of the second back panel, the front panel, or the first back panel. The second back panel forms a tearable section configured to be at least partially removed from a remainder of the second back panel via at least one frangible connection. The card panel includes information accessible after the tearable section is at least partially removed. The information of the card panel includes predetermined or variable monetary value. The front panel, the first back panel, the second back panel, the first minor side flap, and the second minor side flap are folded and attached to one or more of the other panels so as to contain the card panel.

According to one aspect of the present disclosure, the at least one card panel includes at least two card panels. The at least two card panels includes a first card panel and a second card panel. The second card panel is adapted to fold onto and be fixedly connected to the first card panel to form a card.

According to a configuration of the above implementation, the at least one card panel is connected to the second back panel.

According to a further configuration of the above implementation, the at least one card panel is connected to the second back panel via a frangible connection.

In a further aspect of the above implementation, the first and second side flaps are attached to the front panel.

In yet a further aspect of the above implementation, the second back panel further forms an aperture or cutout adjacent to the tearable section. The aperture or cutout assists in accessing an end of the tearable section. The second minor side flap may form an aperture or cutout therein. The aperture or cutout of the second minor side flap is generally aligned with the aperture or cutout of the second back panel after being attached thereto. The second minor side flap may include a plurality of horizontal frangible connections that extend into the aperture or cutout of the second minor side flap.

According to a configuration of the above implementation, the first minor side flap includes a plurality of horizontal frangible connections. The plurality of horizontal frangible connections is generally aligned with the tearable section after the first minor side flap is attached to the second back panel.

According to a configuration of the above implementation, the predetermined or variable monetary value is in the form of a bar code or a QR code.

According to another aspect of the present disclosure, a carrier assembly configured to contain an item includes a front panel, a first back panel, a second back panel, a first minor side flap, and a second minor side flap. The front panel is connected to the first and second back panels via opposing fold lines. The second back panel forms a tearable section configured to be at least partially removed from the remainder of the second back panel via at least one frangible connection as to access information from the item. The first back panel is folded inwardly and attached to the front panel. The second back panel is folded inwardly onto the front panel. The first minor side flap and the second minor side flap are adapted to fold inwardly and being attached so as to assist in containing an item.

According to a configuration of the above implementation, the second back panel is attached to the front panel.

According to a further configuration of the above implementation, a minor back flap is further included. The minor back flap is attached to the second back panel. The minor back flap is folded inwardly and attached to the front panel.

In a further aspect of the above implementation, the first and second side flaps are attached to the front panel.

In yet a further aspect of the above implementation, the second back panel further forms an aperture or cutout adjacent to the tearable section. The aperture or cutout assists in accessing an end of the tearable section.

According to a configuration of the above implementation, the second minor side flap forms an aperture or cutout therein. The aperture or cutout of the second minor side flap is generally aligned with the aperture or cutout of the second back panel after being attached thereto.

According to a configuration of the above implementation, the second minor side flap includes a plurality of horizontal frangible connections that extend into the aperture or cutout of the second minor side flap.

According to a further configuration of the above implementation, the first minor side flap includes a plurality of horizontal frangible connections. The plurality of horizontal frangible connections is generally aligned with the tearable section after the first minor side flap is attached to the second back panel.

According to a further aspect of the present disclosure, the item is a card.

According to a further aspect of the present disclosure, a carrier assembly configured to contain an item including a front panel, a first back flap, a second back flap, a first side flap, and a second side flap. The front panel is connected to the first and second back flaps via opposing fold lines. The first and second side panels is connected to the front panel. The second major flap forms a first tearable section configured to be at least partially removed from the remainder of the second side flap via at least one frangible connection. The second major flap forms a second tearable section configured to be at least partially removed from the remainder of the second major side flap via at least one frangible connection. The first side flap and the second side flap are folded inwardly and attached to each other such that the first and second tearable sections are generally aligned. The first and second back flaps are folded inwardly so as to assist in forming a pocket receive the item.

According to a configuration of the above implementation, the second side flap forms an aperture or cutout. The aperture or cutout is located adjacent to the first tearable section.

According to a further configuration of the above implementation, an item is further included and the item is a card.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1:
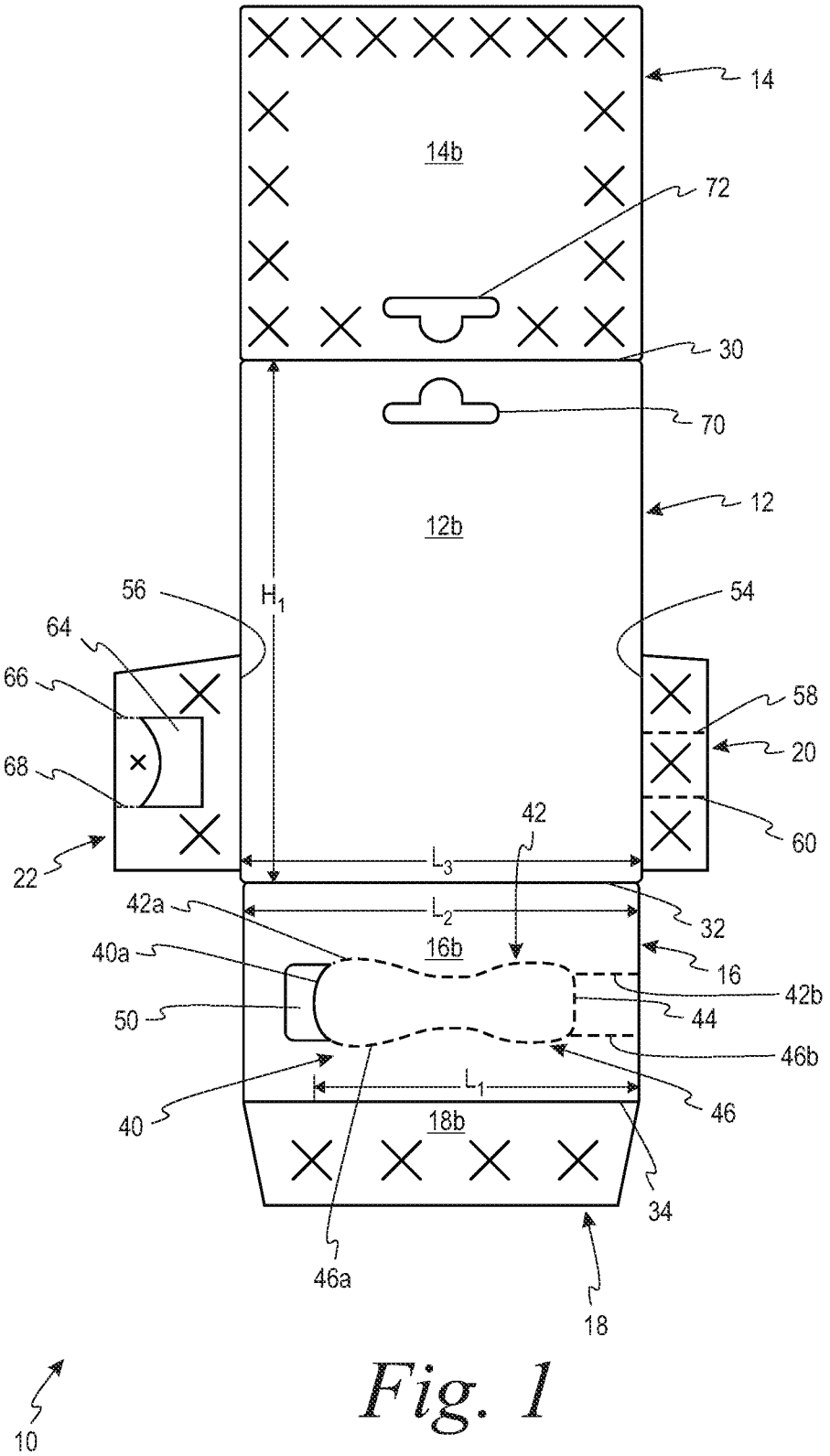
FIG. 1 is a top plan view of a blank for forming a carrier assembly according to one embodiment of the present disclosure.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

FIG. 1 illustrates a top plan view of a blank 10 for forming a carrier assembly according to one embodiment of the present disclosure. The blank 10 includes a plurality of panels and a plurality of flaps. Specifically, the blank 10 includes a front panel 12, a first back panel 14, a second back panel 16, a minor back flap 18, a first minor side flap 20, and a second minor side flap 22. Adjacent panels 12, 14, 16 are hingedly connected with one another by substantially parallel fold lines 30, 32 as shown in FIG. 1. The minor back flap 18 is hingedly connected to the second back panel 16 via a fold line 34 in one embodiment. It is contemplated that the minor back flap and the second back panel may be one continuous panel without any fold lines in another embodiment.

The second back flap 16 forms a tearable section 40 that is configured to be at least partially removable from the remainder of the second back flap. The tearable section assists in obtaining access to an item or items securely stored within the carrier assembly. The tearable section 40 is formed from at least one frangible connection. The plurality of frangible connections is in the form of scoring or scored lines, notches, leaders, nicks or other lines of weaknesses. Specifically, the tearable section 40 includes frangible connections 42, 44, 46. Each of the frangible connections 42, 46 has a respective wave-like portion 42*a*, 46*a* that flattens into a generally straight portion 42*b*, 46*b* at one end. The frangible connection 44 is a generally straight vertical line that extends between the frangible connections 42, 46.

It is contemplated that the at least one frangible connection may be of different shapes and sizes. The at least one frangible connection formed in the second back panel is desirably of a shape and size that enables an individual to gain access to the item stored in the carrier assembly. This typically includes the ability to access information printed or stored on the item.

The tearable section 40 extends longitudinally across the second back panel 16 and has a length L1. The length L1 of the tearable section 40 extends from about 50 to about 95% of a length L2 of the second back panel 16 in one embodiment. In another embodiment, the length L1 of the tearable section 40 extends from about 50 to about 90% of the length L2 of the second back panel 16. In a further embodiment, the length L1 of the tearable section 40 extends from about 60 to about 90% about the length L2 of the second back panel 16. In yet another embodiment, the length L1 of the tearable section 40 extends from about 70 to about 90% about the length L2 of the second back panel 16.

The second back panel 16 further forms an aperture or cutout 50 adjacent to the tearable section 40. The aperture 50 assists a user in accessing an end 40*a* of the tearable section 40. A user in one method will grasp the end 40*a* of the tearable section 40 of the carrier assembly and tear in the direction of arrow A (see FIG. 2D) to at least partially remove or typically fully remove the tearable section 40 from the second back panel. This will be discussed in more detail with respect to FIGS. 2D, 2F below.

The aperture 50 shown in FIG. 1 is a roughly rectangular shape with one of the sides being concave. The aperture 50 should be sufficiently dimensioned to assist a user in accessing an end of the tearable section. It is contemplated that the aperture formed in the second back panel may be of different shapes and sizes than depicted in FIG. 1. Some other shapes that may be used in forming an aperture to access an end of the tearable section include polygonal shapes such as generally rectangular, square, hexagonal or non-polygonal shapes such as semi-circular, oblong, oval or circular.

Referring to FIG. 1, the first and second minor side flaps 20, 22 are connected to the front flap 12 via respective fold lines 54, 56 in the blank 10. At least one of the first and second minor side flaps includes a plurality of horizontal frangible connections in one embodiment to assist in accessing the item securely contained in the carrier assembly. In this embodiment, the first and second minor side flaps 20, 22 include a plurality of horizontal frangible connections to assist in accessing the item in the carrier assembly. The first minor side flap 20 of FIG. 1 includes two generally horizontal frangible connections 58, 60 formed therethrough. After assembly, which will be discussed in detail below, the two generally horizontal frangible connections 58, 60 generally align with respective straight portions 42*b*, 46*b* to assist in removal of the tearable section 40, which enables a user to assess the item securely stored in the carrier assembly.

The second minor side flap 22 forms an aperture or cutout 64 therein. The aperture 64 of the second minor side flap 22 generally corresponds with the aperture 50 formed in the second back panel 16. Like the aperture 50 formed in the second back panel 16, the aperture 64 of the second minor side panel 22 assists in accessing the end 40*a* of the tearable section 40. As shown best in FIG. 2D, the apertures 50, 64 are of a similar shape, but the aperture 64 formed in the second minor side flap 22 is slightly larger than the aperture 50 formed in the second back panel 16. The aperture 64 is typically slightly larger than the aperture 50 to account for tolerances in the folding of the second minor side flap 22 onto the second back panel as will be discussed below.

The aperture 64 shown in FIG. 1 is a roughly rectangular shape with one of the sides being concave. The aperture 64 should be sufficiently dimensioned to assist a user in accessing an end of the tearable section. It is contemplated that the aperture formed in the second minor side flap may be of different shapes and sizes than depicted in FIG. 1. Some other shapes that may be used include polygonal shapes such as generally rectangular, square, hexagonal or non-polygonal shapes such as semi-circular, oblong, oval or circular.

The second minor side flap 22 also includes a plurality of generally horizontal frangible connections 66, 68 that assists a user in removing the tearable section 40 and gaining access to the item securely stored in the carrier assembly. The plurality of horizontal frangible connections 66, 68 extends into the aperture 64 as shown in FIG. 1. The plurality of horizontal frangible connections 66, 68 of the second minor side flap 22 is generally aligned with the tearable section 40 after the carrier assembly is formed.

It is contemplated that the first and second minor side flaps may be attached to a different panel other than the front panel. For example, one or both of the first and second minor side flaps may be attached to the first or second back panel via respective fold lines instead of being attached to the front panel as shown in FIG. 1. In these embodiments, the first and second minor side flaps may be folded and attached to different surfaces so as to secure contain the item within the carrier assembly.

Referring still to FIG. 1, each of the front panel 12 and the first back panel 14 forms a respective opening 70, 72 such that after the first back panel 14 is folded onto the front panel 12, the respective openings 70, 72 of the front panel 12 and the first back panel 14 are generally aligned. The opening 72 is slightly larger than the opening 70 to account for tolerances during the folding process. The openings 70, 72, when adjacent to each other after being folded, together form an opening 74 (see FIGS. 2C, 2D) that is sized to assist in hanging the formed carrier assembly on a display before being purchased by a consumer.

The front panel 12 includes a first surface 12*a* (see FIG. 2E) and a second surface 12*b* (see, e.g., FIG. 1). The front panel 12 as shown in FIG. 1 has a height H1 and a length L3. The first back panel 14 includes a first surface 14*a* (see, e.g., FIG. 2C) and a second surface 14*b* (see, e.g., FIG. 1). The second back panel 16 includes a first surface 16*a* (see, e.g., FIG. 2B) and a second surface 16*b* (see, e.g., FIG. 1). The minor back flap 18 includes a first surface 18*a* (see, e.g., FIG. 2B) and a second surface 18*b* (see, e.g., FIG. 1).

Figure 2A:
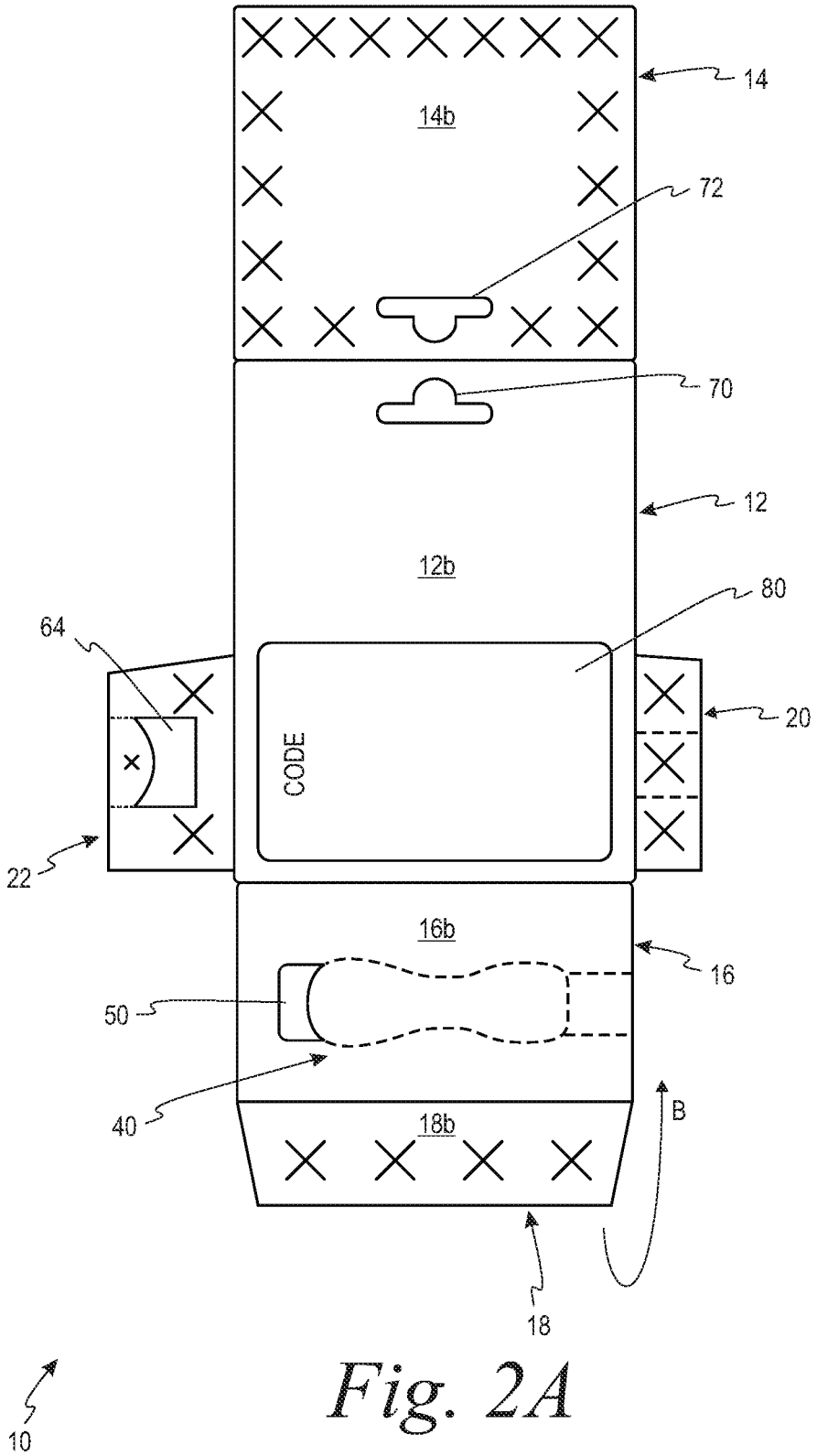
FIG. 2A is a top plan view of the blank of FIG. 1 with an item (e.g., gift card) included thereon according to one embodiment of the present disclosure.

Referring to FIGS. 2A-2E, a sequence of steps for converting the blank 10 into a carrier assembly 90 is shown. FIG. 2A shows the blank 10 with an item 80 being located on the front panel 12. The item 80 may be detachably connected to the front panel 12 in one embodiment such as with removable adhesive. In another embodiment, the item 80 may be unattached to the front panel 12. The item 80 is a card such as a gift card in one embodiment.

Figure 2B:
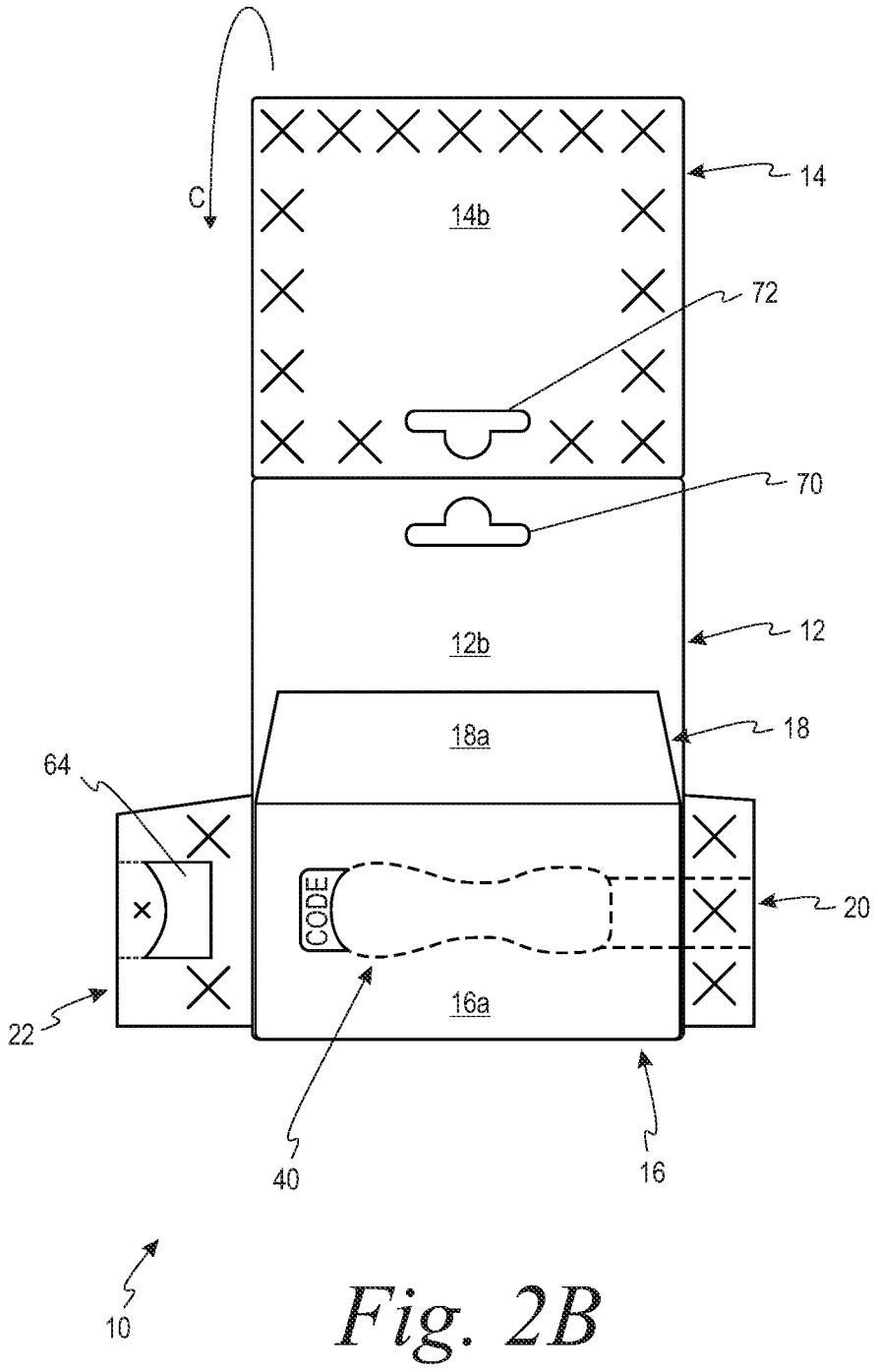
FIG. 2B is a top plan view of the blank of FIG. 2A after folding and attaching a second back panel and minor back flap according to one embodiment of the present disclosure.

After the item 80 is added to the blank 10, the second back panel 16 and the minor back flap 18 are folded via arrow B over the item 80 and onto the second surface 12*b* of the front panel 12. This positioning is shown in FIG. 2B. The minor back flap 18 is attached to the second surface 12*b* of the front panel 12. This attachment of the minor back flap 18 and the front panel 12 may be formed in the area generally indicated by four "X"s in the minor back flap 18 (see FIG. 2A). The adhesive may be located on at least one of the surfaces of the minor back flap 18 and the front panel 12. It is contemplated that the attachment of the minor back flap 18 and the front panel 12 may be formed in areas other than that indicated by four "X"s in the minor back flap 18.

Figure 2C:
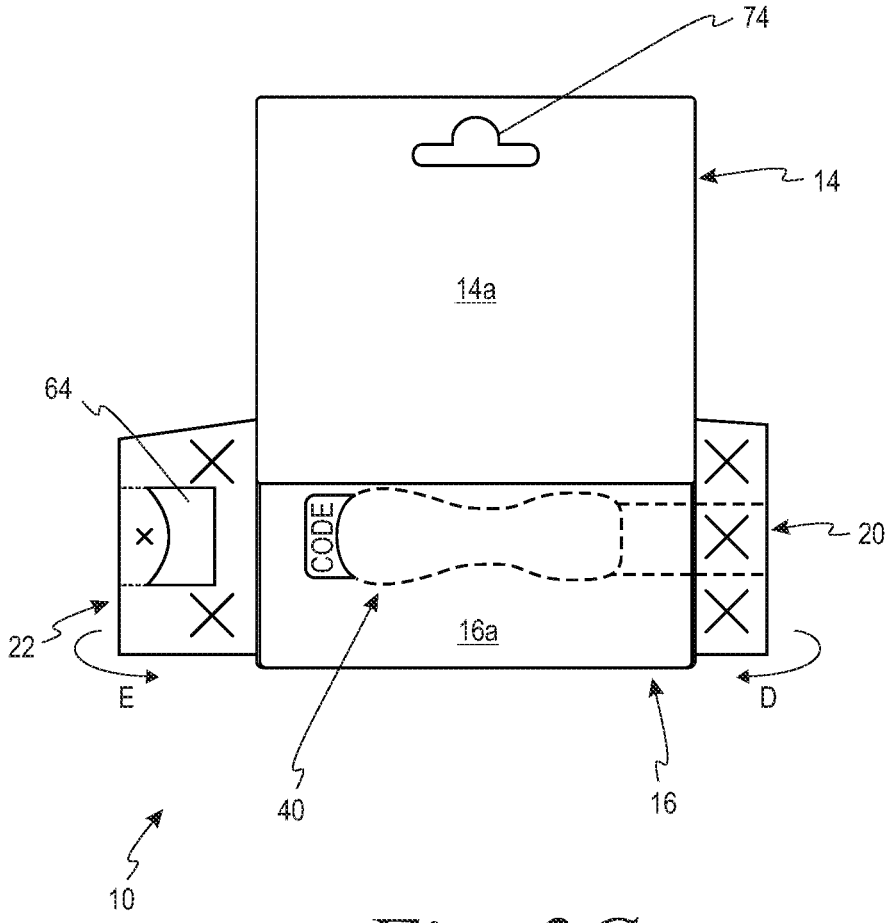
FIG. 2C is a top plan view of the blank of FIG. 2B after folding and attaching a first back panel according to one embodiment of the present disclosure.

Referring to FIGS. 2B, 2C, the first back panel 14 in this embodiment is folded forward via arrow C and attached to the front panel 12, the minor back flap 18, and the second back panel 16. In this embodiment, the first back panel 14 has adhesive located along its periphery (area with "X"s) and is attached to the front panel 12, the minor back flap 18 and the second back panel 16. It is contemplated that adhesive may be located on one or more of the surfaces of the first back flap 14, the front panel 12, the minor back flap 18 and the second back panel 16. It is contemplated that the adhesive may be located in different locations than depicted in FIG. 2B. It is also contemplated that the adhesive may be located in a lesser or greater number of locations.

Figure 2D:
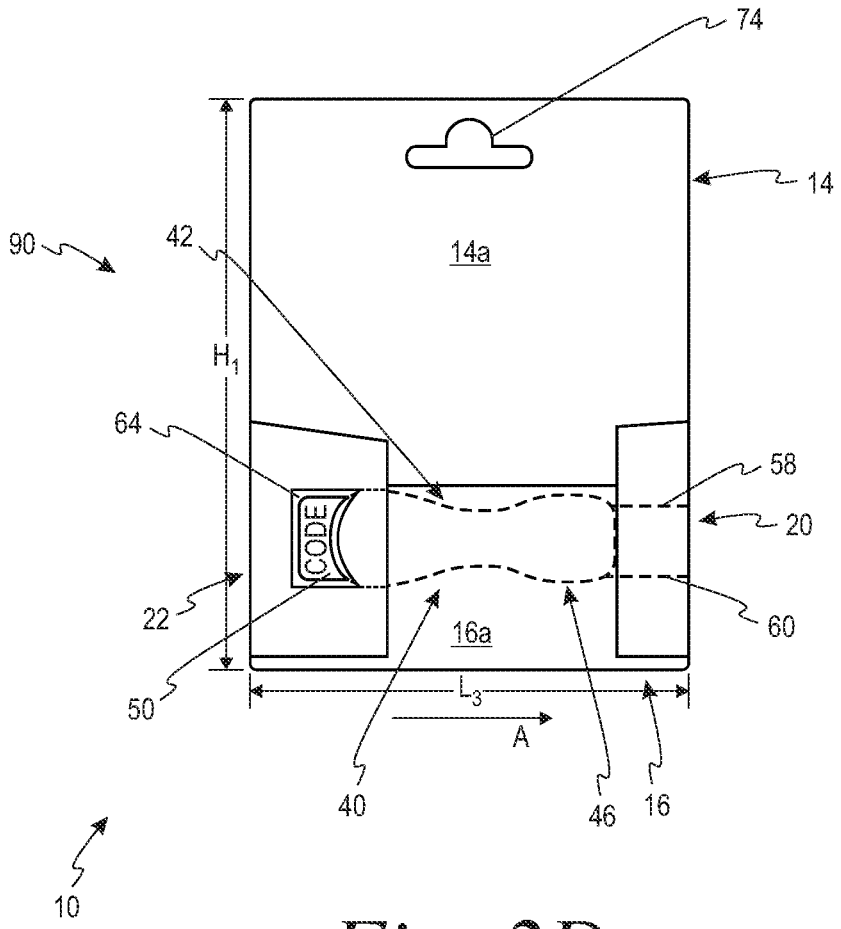
FIG. 2D is a top plan view of a carrier assembly in an unopened position after the first and second minor side flaps of the blank of FIG. 2C have been folded and attached according to one embodiment of the present disclosure.

Referring to FIGS. 2C, 2D, each of the first and second minor side flaps 20, 22 is folded inwardly in the direction of respective arrows D, E. The first and second minor side flaps 20, 22 are attached to the first back panel 14 and the second back panel 16 in FIG. 2D. In this embodiment, each of the first and second minor side flaps 20, 22 has adhesive located along its periphery (area with multiples "X"s) as shown in FIG. 2C. It is contemplated that adhesive may be located on one or more of the surfaces of the first and second minor side flaps 20, 22, the first back panel 14 and the second back panel 16. It is contemplated that the adhesive may be located in different locations than depicted in FIG. 2C. It is also contemplated that the adhesive may be located in a lesser or greater number of locations.

Figure 2E:
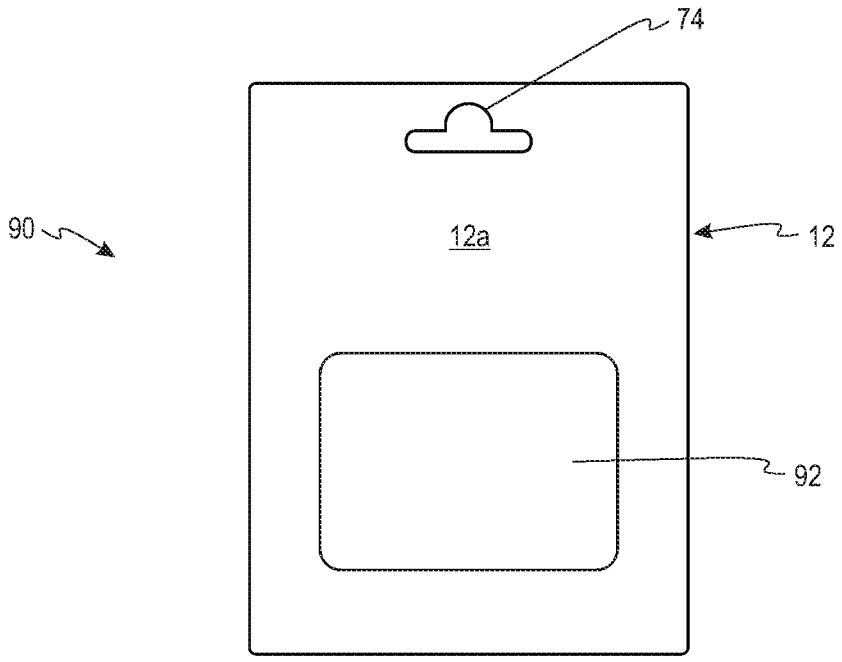
FIG. 2E is an opposing top plan view of the carrier assembly of FIG. 2D.

FIG. 2D shows a top plan view of the carrier assembly 90 in an unopened position, which is a back view of the carrier assembly. FIG. 2E shows an opposing top plan view of the carrier assembly 90 in an unopened position, which is a front view of the carrier assembly. FIG. 2E identifies an area 92 on the front side of the carrier assembly 90. This area 92 or other areas of the carrier assembly typically includes descriptions, graphics, advertising features, marketing, logos, pre-determined value, variable values or range of values, or other information thereon. Some additional information may include written or visual instructions on how to access the item or items of the carrier assemblies of the present invention.

Figure 2F:
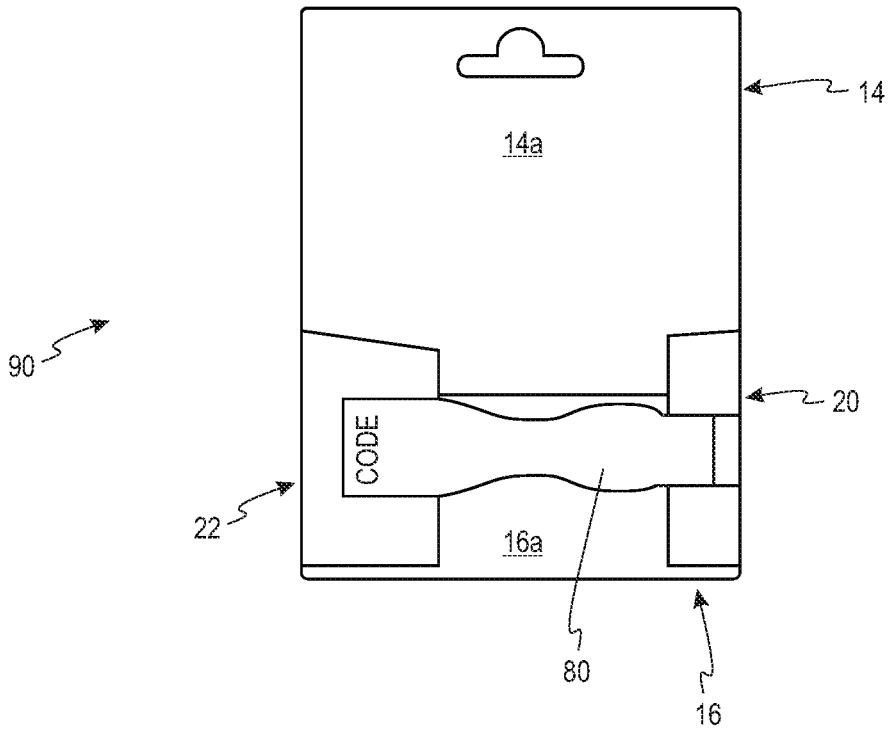
FIG. 2F is a top plan view of the carrier assembly of FIG. 2D in an opened position after removal of a tearable section according to one embodiment of the present disclosure.

Referring back to FIG. 2D, a user, to gain access to the item 80 stored in the carrier assembly 90, grasps the end 40*a* of the tearable section 40 and pulls the tearable section 40 in the direction of arrow A. FIG. 2F shows the carrier assembly 90 after the tearable section 40 has been removed, which exposes a horizontally-extending portion of the item 80. It is contemplated that in other embodiments that the tearable section may not be removed fully removed. After the tearable section 40 has been partially or fully removable, this indicates to a purchaser that the information on the item 80 may have been accessed previously.

In one process, an individual purchases the item 80 that is included in the carrier assembly. During the purchase process, an employee will typically at least partially remove the tearable section 40 and activate the item (e.g., gift card) by using the information exposed on the item. The item in one embodiment includes predetermined or variable monetary value. A predetermined value is a static monetary value. The variable monetary value is typically a range of values that is set at time of purchase. The predetermined or variable monetary value is typically in the form of a bar code, QR code, or magnetic strip. It is contemplated that the predetermined or variable monetary value may be in other forms.

Figure 3A:
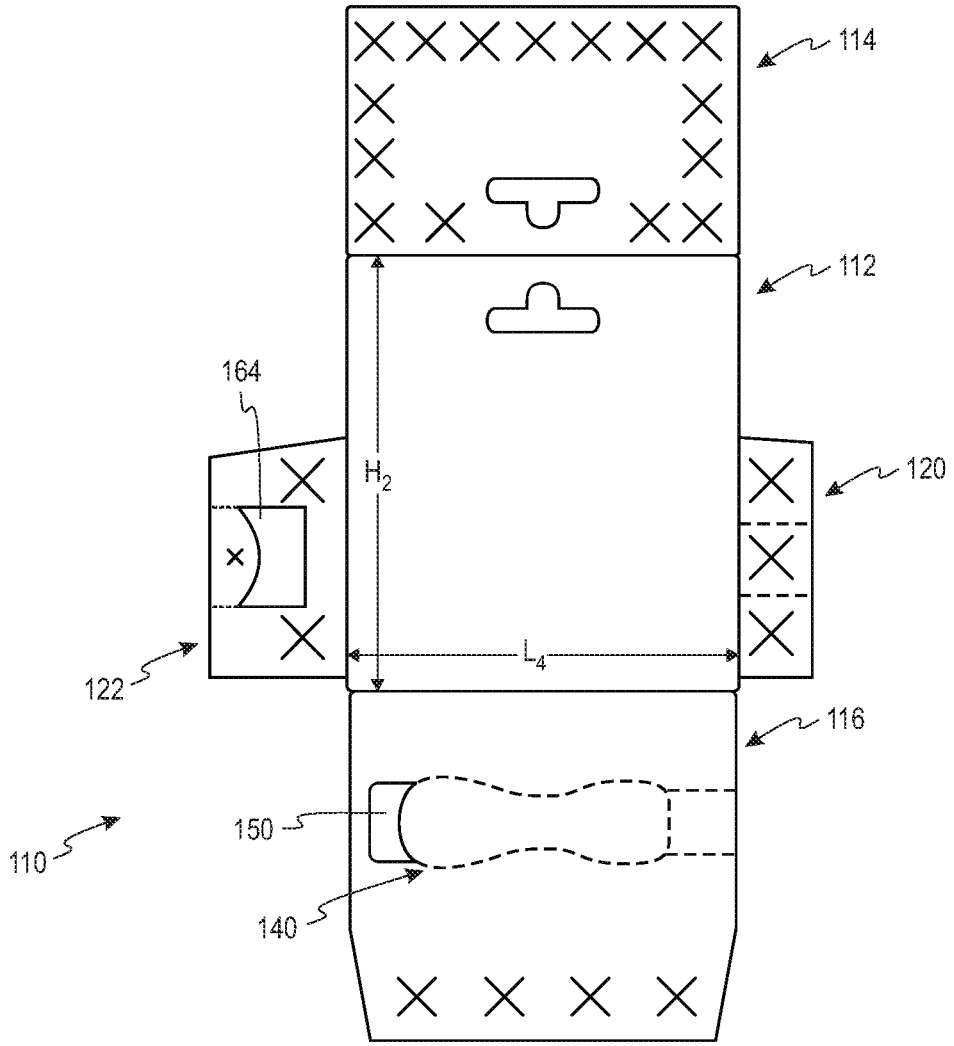
FIG. 3A is a top plan view of a blank for forming a carrier assembly according to another embodiment of the present disclosure.

It is contemplated that the carrier assembly may be of other sizes with similar features as shown in FIG. 3. For example, a blank 110 is shown in FIG. 3A. The blank 110 of FIG. 3A includes a front flap 112, a first back flap 114, a second back flap 116, a first side flap 120 and a second side flap 122. The second back flap 116 includes a tearable section 140 and forms an aperture or cutout 150. The second side flap 122 forms an aperture 164. The functionality of the front flap 112, the first back flap 114, the second back flap 116, the first side flap 120 and the second side flap 122 is the same as described above with respective front flap 12, first back flap 14, second back flap 16, first side flap 120 and second side flap 122.

Figure 3B:
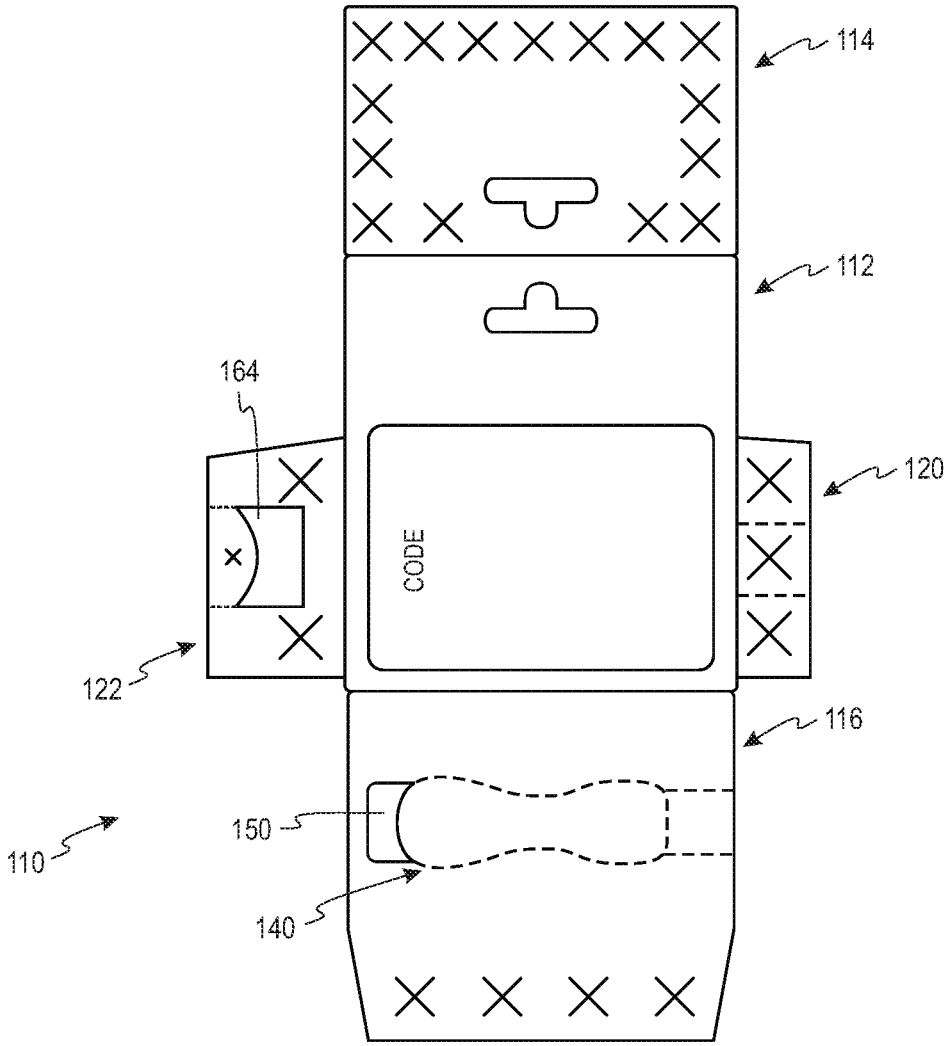
FIG. 3B is a top plan view of the blank of FIG. 3A with an item (e.g., gift card) included thereon according to another embodiment of the present disclosure.

The dimensions of the panels of the blank 110 of FIG. 3A are different than the dimensions of the panels of the blank 10 of FIG. 1. For example, the front panel 12 has the height H1 and the length L3, while the front panel 112 has a height H2 and a length L4. The height H1 is greater than the height H2 in this embodiment. The length L3 and length LA are about the same in these embodiments. FIG. 3B shows the blank 110 with an item 80 adjacent to the front panel 112.

Figure 4:
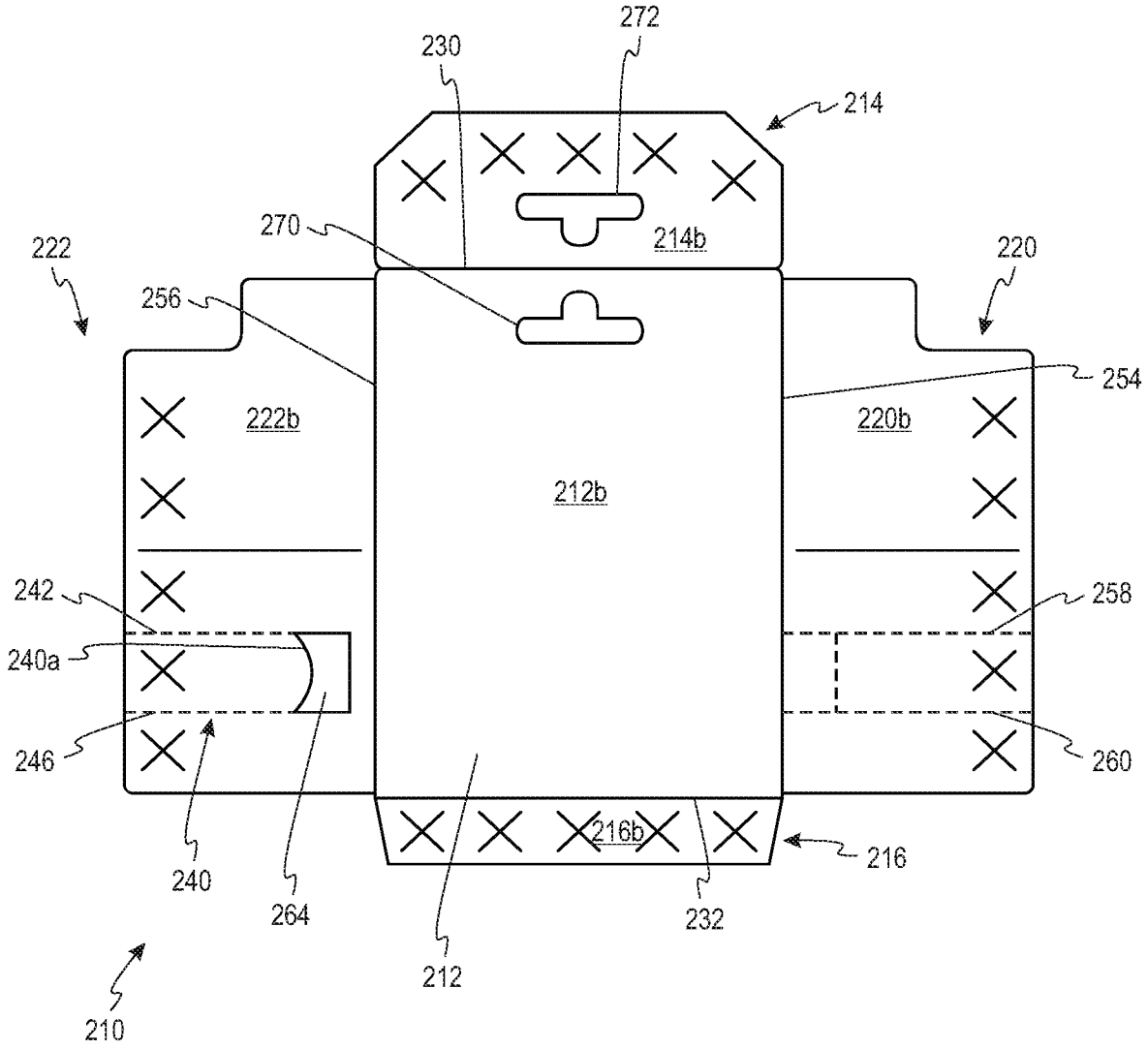
FIG. 4 is a top plan view of a blank for forming a carrier assembly according to a further embodiment of the present disclosure.

Referring to FIG. 4, a top plan view of a blank 210 for forming a carrier assembly is shown according to a further embodiment of the present disclosure. The blank 210 includes a plurality of panels and a plurality of flaps. Specifically, the blank 210 includes a front panel 212, a first back flap 214, a second back flap 216, a first side panel 220 and a second side panel 222. Adjacent panels 212, 214, 216 are hingedly connected with one another by substantially parallel fold lines 230, 232 as shown in FIG. 4. The first and second side panels 220, 222 are connected to the front flap 212 via respective fold lines 254, 256 in the blank 210.

The second side panel 222 forms a tearable section 240 that is configured to be at least partially removable from the remainder of the second side panel. The tearable section 240 assists in obtaining access to an items securely stored within the carrier assembly. The tearable section 240 is formed from at least one frangible connection. Specifically, the tearable section 240 includes frangible connections 242, 244. Each of the frangible connections 242, 244 is a generally horizontal line.

The second side panel 222 further forms an aperture or cutout 264 adjacent to the tearable section 240. The aperture 264 assists a user in accessing an end 240*a* of the tearable section 240. A user in one method will grasp the end 240*a* of the tearable section 240 and tear in the direction of arrow A (FIG. 5C) to at least partially remove or typically fully remove the tearable section 240 from the second side panel, which will be discussed in more detail below.

The aperture 264 shown in FIG. 4 is a roughly rectangular shape with one of the sides being concave. The aperture 264 should be sufficiently dimensioned to assist a user in accessing an end of the tearable section. It is contemplated that the aperture formed in the second side panel may be of different shapes and sizes than depicted in FIG. 4. Some other shapes that may be used in forming an aperture to access an end of the tearable section include polygonal shapes such as generally rectangular, square, hexagonal or non-polygonal shapes such as semi-circular, oblong, oval or circular.

The first side panel 220 also includes a plurality of frangible connections 258, 260 that extend across the entire length of the first side panel 220 in this embodiment. The frangible connection 258, 260 are also generally horizontal lines and are generally aligned with the frangible connections 242, 244 after both have been folded inwardly as will be discussed below. The frangible connections 258 and 260 form a second tearable section that assists with the first tearable section 240 to expose and access information on an item or items when removed.

It is contemplated that the frangible connections may be of different shapes and sizes. The frangible connections formed in the first and second side panels are desirably of shapes and sizes that enable an individual to gain access to the item securely stored in the carrier assembly. This typically includes the ability to access information printed or stored on the item.

Referring still to FIG. 4, each of the front panel 212 and the first back flap 214 forms a respective opening 270, 272 such that after the first back flap 214 is folded onto the front panel 212, the respective openings 270, 272 of the front panel 212 and the first back flap 214 are generally aligned. The opening 272 is slightly larger than the opening 270 to account for tolerances during the folding process. The openings 270, 272, when adjacent to each other after being folded, together form an opening 274 (see FIGS. 5C, 5D) that is sized to assist in hanging the formed carrier assembly on a display before being purchased by a consumer.

The front panel 212 includes a first surface 212*a* (see FIG. 5D) and a second surface 212*b* (see, e.g., FIG. 4). The first back flap 214 includes a first surface 214*a* (see, e.g., FIG. 5C) and a second surface 214*b* (see, e.g., FIG. 4). The second back flap 216 includes a first surface 216*a* (see, e.g., FIG. 5C) and a second surface 216*b* (see, e.g., FIG. 4). The first side panel 220 includes a first surface 220*a* (see, e.g., FIG. 5B) and a second surface 220*b* (see, e.g., FIG. 4). The second side panel 222 includes a first surface 222*a* (see, e.g., FIG. 5B) and a second surface 222*b* (see, e.g., FIG. 4).

Figure 5A:
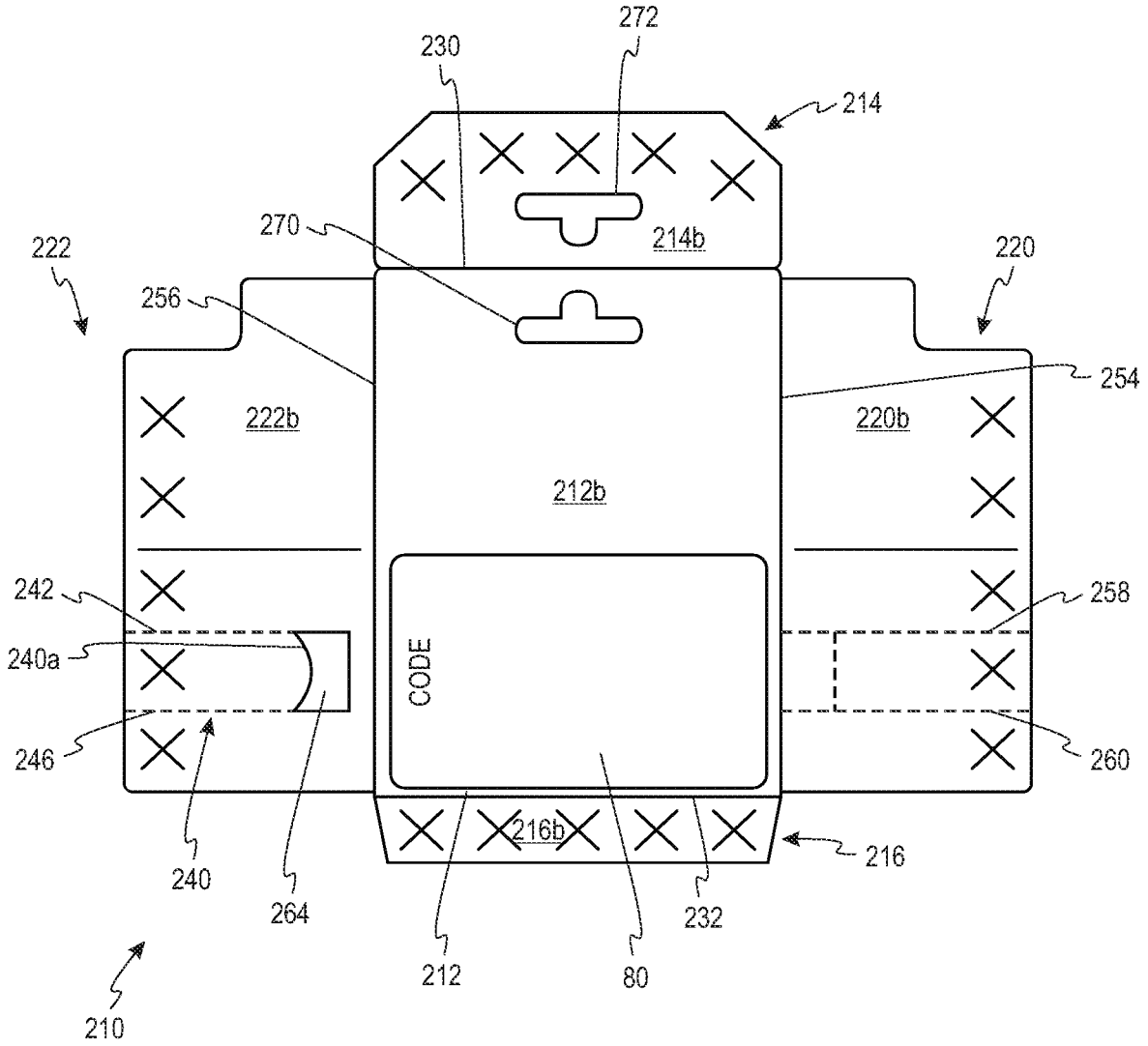
FIG. 5A is a top plan view of the blank of FIG. 4 with an item (e.g., gift card) included thereon according to one embodiment of the present disclosure.

Referring to FIGS. 5A-5E, a sequence of steps for converting the blank 210 into a carrier assembly 290 is shown. FIG. 5A shows the blank 210 with an item 80 being located on the front panel 212. The item 80 may be detachably connected to the front panel 212 in one embodiment such as with removable adhesive. In another embodiment, the item 80 may be unattached to the front panel 212. The item 80 is a card such as a gift card in one embodiment.

Figure 5B:
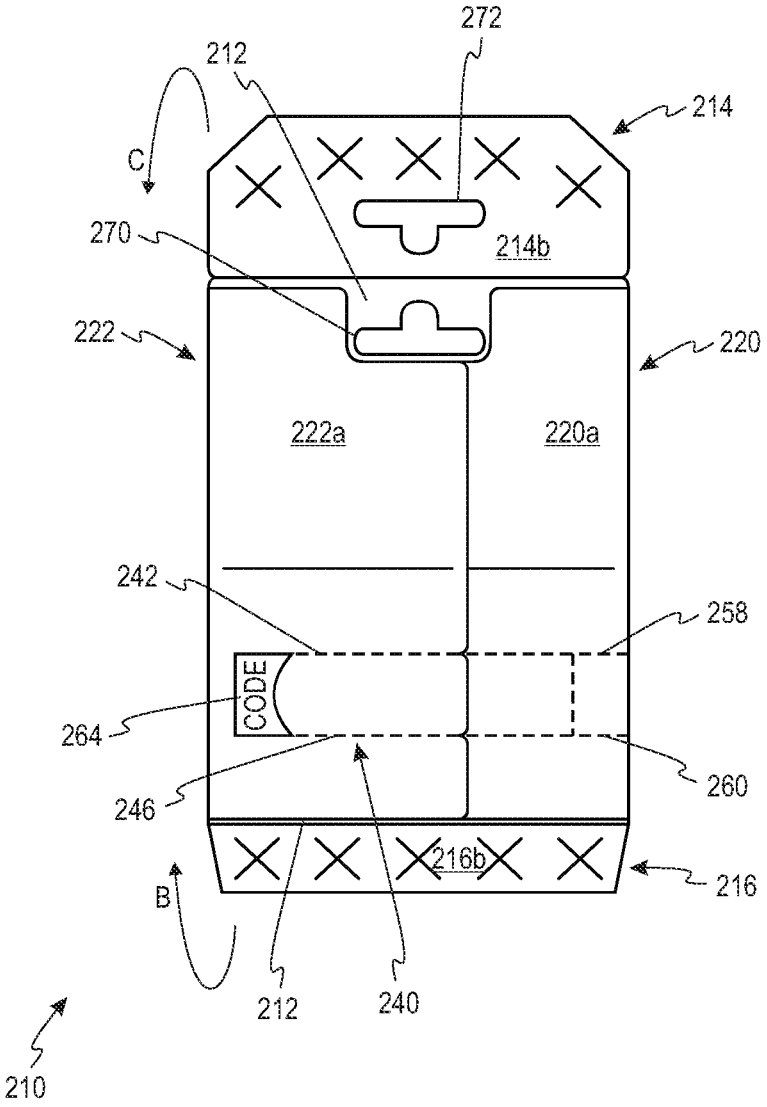
FIG. 5B is a top plan view of the blank of FIG. 5A after folding and attaching two side panels according to one embodiment of the present disclosure.

After the item 80 is added to the blank 210, the first and second side panels 220, 222 are folded inwardly over the item 80 and onto the second surface 212*b* of the front panel 212. This positioning is shown in FIG. 5B. In this embodiment, the first side panel 220 is folded initially onto the front panel 212 and then, the second side panel 222 is folded onto the front panel 212 and the first side panel 220. The attachment of the first and second side panels 220, 222 to the front panel 212 may be formed in the area generally indicated by five "X"s (see FIG. 5A) on each of the first and second side panels 220, 222. The adhesive may be located on at least one of the surfaces of the first and second side panels 220, 222 and the front panel 212. It is contemplated that the attachment of the first and second side panels 220, 222 and the front panel 212 may be formed in areas other than that indicated by the five "X"s in each of the first and second side panels 220, 222. It is also contemplated that the adhesive may be located in a lesser or greater number of locations.

Figure 5C:
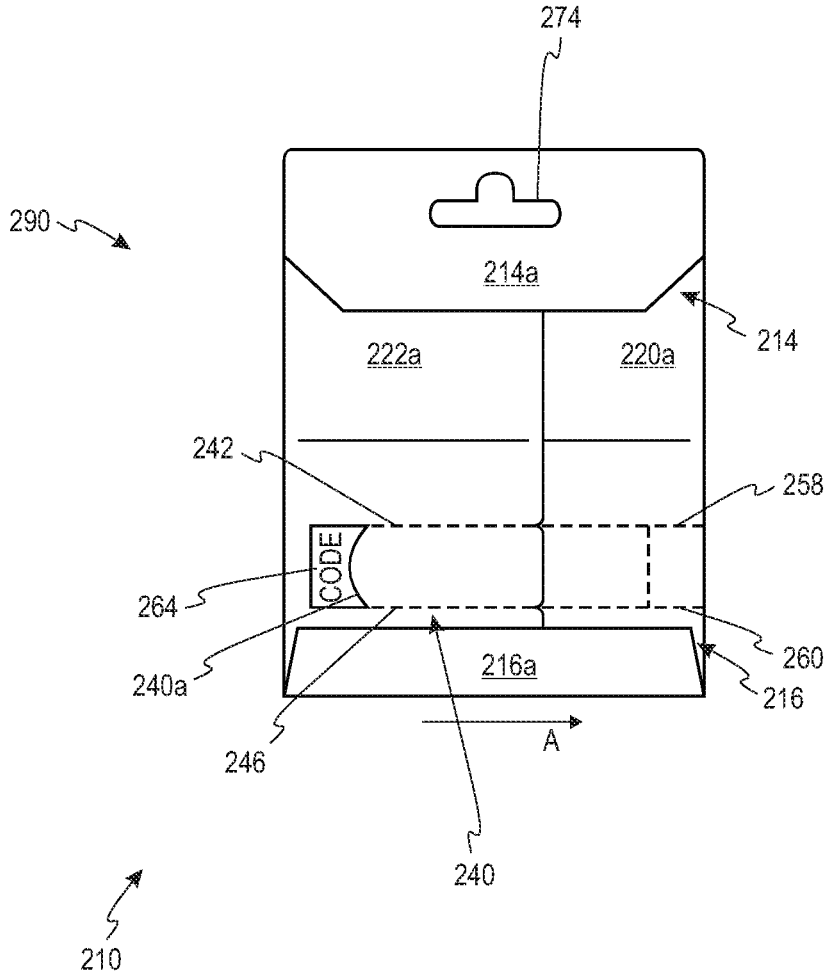
FIG. 5C is a top plan view of a carrier assembly in an unopened position after the first and second back flaps of the blank of FIG. 5B have been folded and attached according to one embodiment of the present disclosure.

Referring to FIGS. 5B, 5C, the first back flap 214 in this embodiment is folded inwardly via arrow C and attached to the first and second side panels 220, 222. The second back flap 216 in this embodiment is folded inwardly via arrow B and attached to the first and second side panels 220, 222. In this embodiment, the first back flap 214 has adhesive located along its periphery (area with "X"s) and is attached to the first and second side panels 220, 222. In this embodiment, the second back flap 216 has adhesive located along its periphery (area with "X"s) and is attached to the first and second side panels 220, 222. Neither of these attachments interferes with the tearable section 240. It is contemplated that adhesive may be located on one or more of the surfaces of the first and second back flaps 214, 216 and the first and second side panels 220, 222. It is contemplated that the adhesive may be located in different locations than depicted in FIG. 5B. It is also contemplated that the adhesive may be located in a lesser or greater number of locations.

Figure 5D:
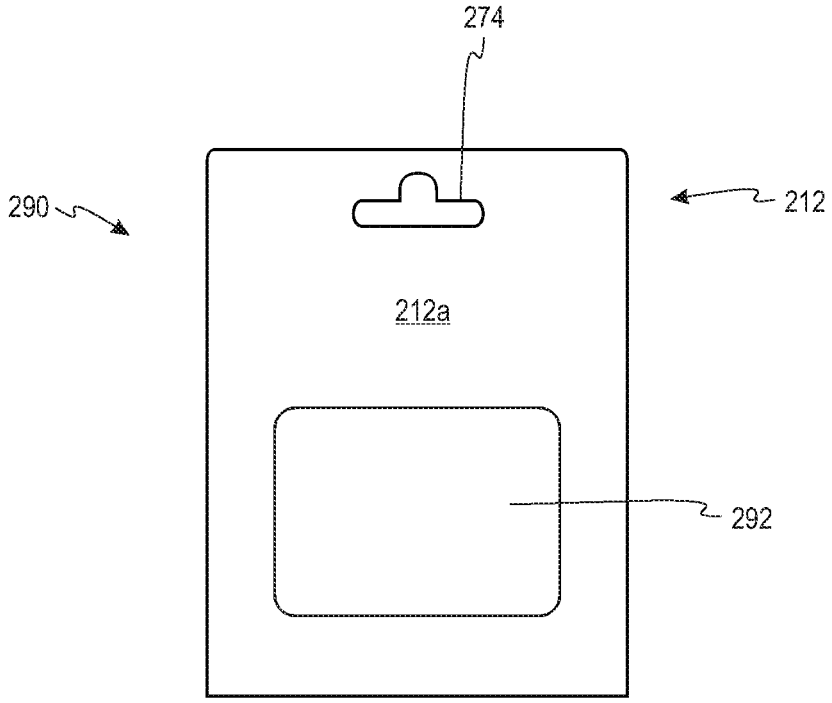
FIG. 5D is an opposing top plan view of the carrier assembly of FIG. 5C.
Figure 5E:
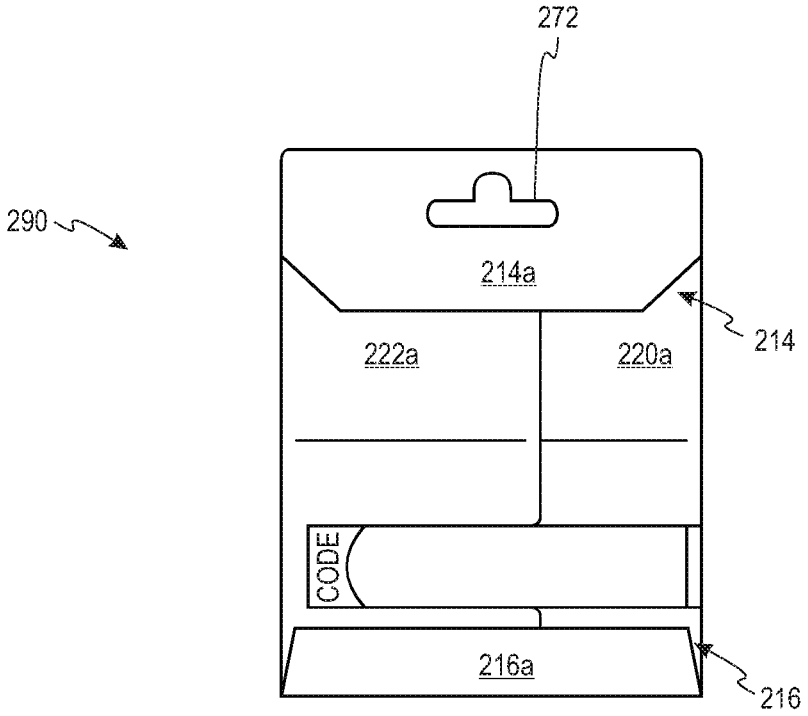
FIG. 5E is a top plan view of the carrier assembly of FIG. 5C in an opened position after removal of a tearable section according to one embodiment of the present disclosure.

FIG. 5C shows a top plan view of the carrier assembly 290 in an unopened position, which is a back view of the carrier assembly. FIG. 5D shows an opposing top plan view of the carrier assembly 290 in an unopened position, which is a front view of the carrier assembly. FIG. 5E identifies an area 292 on the front side of the carrier assembly 290. This area 292 or other areas of the carrier assembly include descriptions, graphics, advertising features, or other information thereon. Some additional information may include written or visual instructions on how to access the contents of the carrier assemblies of the present invention.

Referring back to FIG. 5C, a user, to gain access to the item 80 securely stored in the carrier assembly 290, grasps the end 240*a* of the tearable section 240 and pulls the tearable section 240 in the direction of arrow A. FIG. 5E shows the carrier assembly 290 after the tearable section 240 has been removed, which exposes a horizontally-extending portion of the item 80. It is contemplated that in other embodiments that the tearable section may not be removed fully removed. After the tearable section 240 has been partially or fully removable, this indicates to a purchaser that the information on the item 80 may have been accessed previously.

In one process, an individual purchases the item 80 that is included in the carrier assembly. During the purchase process, an employee will typically at least partially remove the tearable section 240 and activate the item (e.g., gift card) by using the information exposed on the item.

Figure 6:
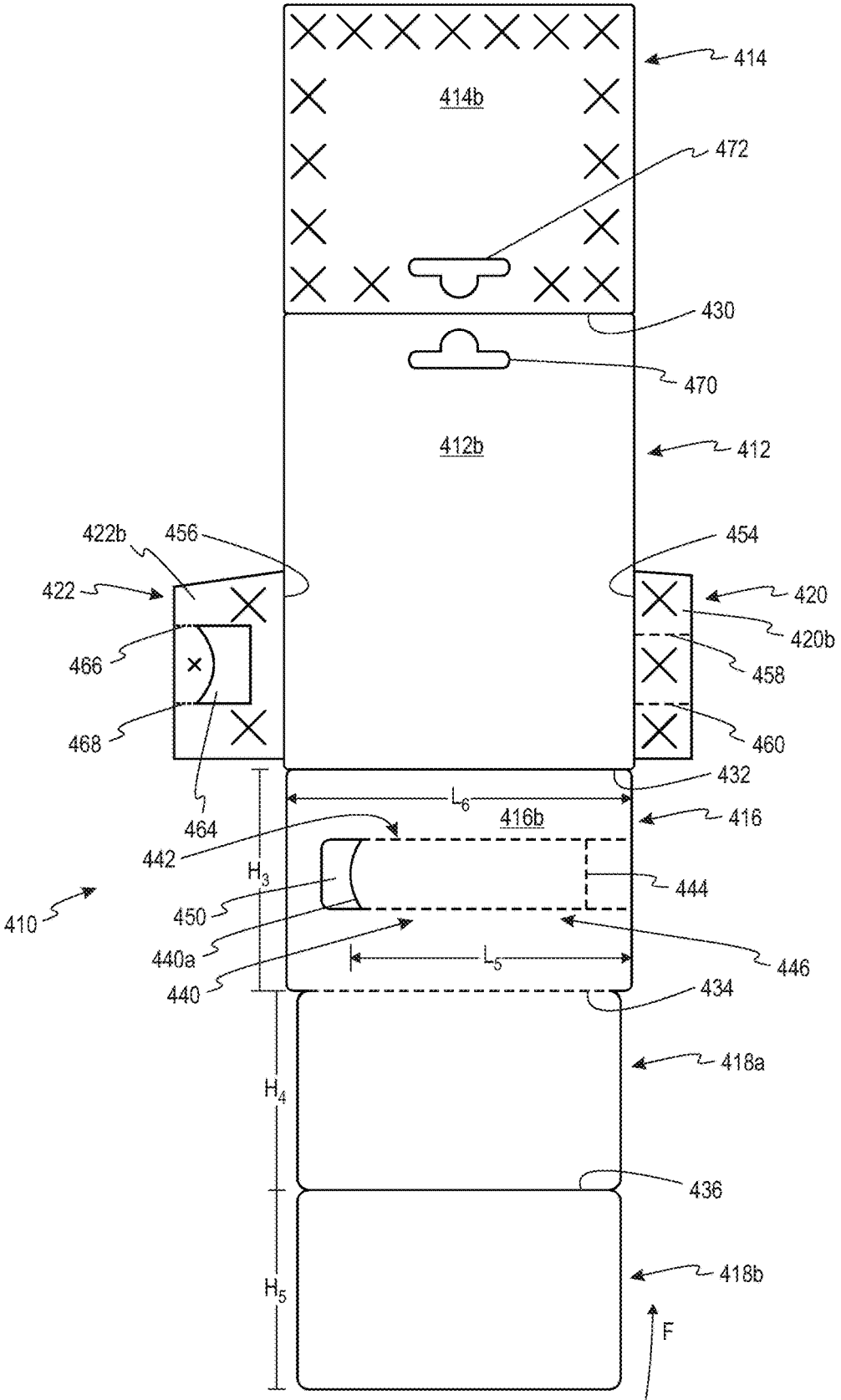
FIG. 6 is a top plan view of a blank for forming a carrier assembly according to yet another embodiment of the present disclosure.

FIG. 6 illustrates a top plan view of a blank 410 for forming a carrier assembly according to yet another embodiment of the present disclosure. The blank 410 includes a plurality of panels and a plurality of flaps. Specifically, the blank 410 includes a front panel 412, a first back panel 414, a second back panel 416, at least one card panel 418*a*, 418*b*, a first minor side flap 420, and a second minor side flap 422. Adjacent panels 412, 414, 416 are hingedly connected with one another by substantially parallel fold lines 430, 432 as shown in FIG. 6. The card panel 418*a* is connected to the second back panel 416 via a frangible connection 434. The card panel 418*b* is hingedly connected to the card panel 418 *a* via a fold line 436. It is contemplated that instead of having two card panels 418*a*, 418*b* in a blank, that the blank may include exactly one card panel. It is also contemplated that there may be more than two card panels in a blank such as, for example, a three card panel.

The at least one card panel 418*a*, 418*b* in one embodiment includes predetermined or variable monetary value. A predetermined monetary value is a static monetary value. The variable monetary value is typically a range of values that is set at time of purchase. The predetermined or variable monetary value in the at least one card panel is typically in the form of a bar code or QR code. It is contemplated that the predetermined or variable monetary value may be in other forms such as, for example, a magnetic strip added to the panel.

The second back panel 416 forms a tearable section 440 that is configured to be at least partially removable from the remainder of the second back flap. The tearable section 440 assists in obtaining access to an item stored within the carrier assembly and functions the same as the tearable section 40 discussed above. The tearable section is formed from at least one frangible connection. Specifically, the tearable section 440 includes frangible connections 442, 444, 446. Each of the frangible connections 442, 446 is a generally straight portion that extends across most of the second back panel 416. The frangible connection 444 is a generally straight vertical line that extends between the frangible connections 442, 446.

It is contemplated that the at least one frangible connection may be of different shapes and sizes. The at least one frangible connection formed in the second back panel is desirably of a shape and size that enables an individual to gain access to the item stored in the carrier assembly. This typically includes the ability to access information printed or stored on the item.

The tearable section 440 extends longitudinally across the second back panel 416 and has a length L5. The length L5 of the tearable section 440 extends from about 50 to about 90% of the length L6 of the second back panel 416 in one embodiment. In another embodiment, the length L5 of the tearable section 440 extends from about 60 to about 80% of the length L6 of the second back panel 416. In a further embodiment, the length L5 of the tearable section 440 extends from about 50 to about 80% about the length L6 of the second back panel 416.

The second back panel 416 further forms an aperture or cutout 450 adjacent to the tearable section 440. The aperture 450 assists a user in accessing an end 440*a* of the tearable section 440. A user in one method will grasp the end 440*a* of the tearable section 440 and tear in the direction of arrow A (see FIG. 7E) to at least partially remove or typically fully remove the tearable section 440 from the second back panel. This will be discussed in more detail with respect to FIGS. 7E, 7G below.

The aperture 450 shown in FIG. 6 is a roughly rectangular shape with one of the sides being concave. The aperture 450 should be sufficiently dimensioned to assist a user in accessing an end of the tearable section. It is contemplated that the aperture formed in the second back panel may be of different shapes and sizes than depicted in FIG. 6. Some other shapes that may be used in forming an aperture to access an end of the tearable section include polygonal shapes such as generally rectangular, square, hexagonal or non-polygonal shapes such as semi-circular, oblong, oval or circular.

Referring to FIG. 6, the first and second minor side flaps 420, 422 are connected to the front flap 412 via respective fold lines 454, 456 in the blank 410. At least one of the first and second minor side flaps 420, 422 includes a plurality of horizontal frangible connections in one embodiment to assist in accessing an item securely contained in the carrier assembly. In this embodiment, the first and second minor side flaps 420, 422 include a plurality of horizontal frangible connections to assist in accessing the item in the carrier assembly. The first minor side flap 420 of FIG. 6 includes two generally horizontal frangible connections 458, 460 formed therethrough. After assembly, which will be discussed in detail below, the two generally horizontal frangible connections 458, 460 generally align with frangible connections 442, 446 to assist in removal of the tearable section 440, which enables a user to assess the item securely stored in the carrier assembly.

The second minor side flap 422 forms an aperture or cutout 464 therein. The aperture 464 of the second minor side flap 422 generally corresponds with the aperture 450 formed in the second back panel 416. Like the aperture 450 formed in the second back panel 416, the aperture 464 of the second minor side flap 422 assists in accessing the end 440*a* of the tearable section 440. As shown best in FIG. 7E, the apertures 450, 464 are of a similar shape, but the aperture 464 formed in the second minor side flap 422 is slightly larger than the aperture 450 formed in the second back panel 416 to account for potential tolerances as discussed above.

The aperture 464 shown in FIG. 6 is a roughly rectangular shape with one of the sides being concave. The aperture 464 should be sufficiently dimensioned to assist a user in accessing an end of the tearable section. It is contemplated that the aperture formed in the second minor side flap may be of different shapes and sizes than depicted in FIG. 6. Some other shapes that may be used include polygonal shapes such as generally rectangular, square, hexagonal or non-polygonal shapes such as semi-circular, oblong, oval or circular.

The second minor side flap 422 also includes a plurality of horizontal frangible connections 466, 468 that assists a user in removing the tearable section 440 and gaining access to the item securely stored in the carrier assembly. The plurality of horizontal frangible connections 466, 468 extends into the aperture 464 as shown in FIG. 6. The plurality of horizontal frangible connections 466, 468 of the second minor side flap 422 is generally aligned with the tearable section 440 after the carrier assembly is formed.

It is contemplated that the first and second minor side flaps may be attached to a different panel other than the front panel. For example, one or both of the first and second minor side flaps may be attached to the first or second back panel via respective fold lines instead of being attached to the front panel as shown in FIG. 6. In these embodiments, the first and second minor side flaps may be folded and attached to different surfaces so as to securely contain the item within the carrier assembly.

Referring still to FIG. 6, each of the front panel 412 and the first back panel 414 forms a respective opening 470, 472 such that after the first back panel 414 is folded onto the front panel 412, the respective openings 470, 472 of the front panel 412 and the first back panel 414 are generally aligned. The opening 472 is slightly larger than the opening 470 to account for tolerances during the folding process. The openings 470, 472, when adjacent to each other after being folded, together form an opening 474 (see FIGS. 7D, 7E) that is sized to assist in hanging the formed carrier assembly on a display before being purchased by a consumer.

The front panel 412 includes a first surface 412*a* (see FIG. 7F) and a second surface 412*b* (see, e.g., FIG. 6). The first back panel 414 includes a first surface 414*a* (see, e.g., FIG. 7D) and a second surface 414*b* (see, e.g., FIG. 6). The second back panel 416 includes a first surface 416*a* (see, e.g., FIG. 2B) and a second surface 416*b* (see, e.g., FIG. 6). The first minor side flap 420 includes a first surface 420*a* (see FIG. 7E) and a second surface 420*b* (see, e.g., FIG. 6). The first minor side flap 422 includes a first surface 422*a* (see FIG. 7E) and a second surface 422*b* (see, e.g., FIG. 6).

Figure 7A:
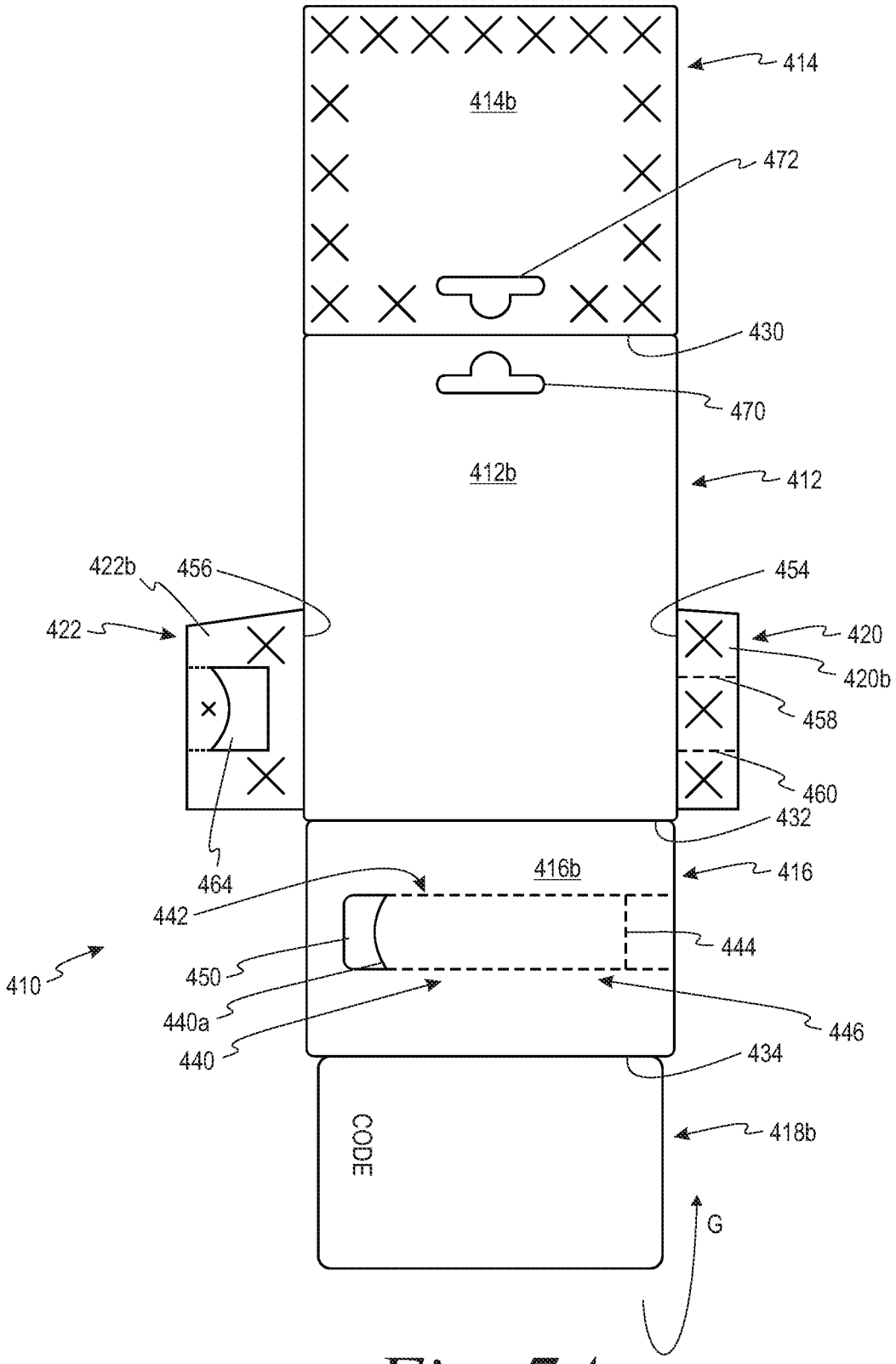
FIG. 7A is a top plan view of the blank of FIG. 6 after folding and attaching a second card panel onto a first card panel according to one embodiment of the present disclosure.

Referring to FIGS. 7A-7G, a sequence of steps for converting the blank 410 into a carrier assembly 490 is shown. Referring initially to FIGS. 6, 7A, the card panel 418*b* is folded onto and attached to the card panel 418*a* via arrow F. The card panels 418*a*, 418*b* may be attached by an adhesive.

In this embodiment, the formed card is of a double thickness. It is desirable to have a formed card of a double thickness to prevent or inhibiting any damage to the card and also to correlate with the general thickness of other cards. If of a double thickness, the card is typically from about 18 to about 32 mils and, more specifically, from about 20 to about 30 mils.

It is contemplated that the card may be formed of other thickness such a single thick card or a triple of more thick cards. The number of card panels will thus correlate with the thickness of the card.

Figure 7B:
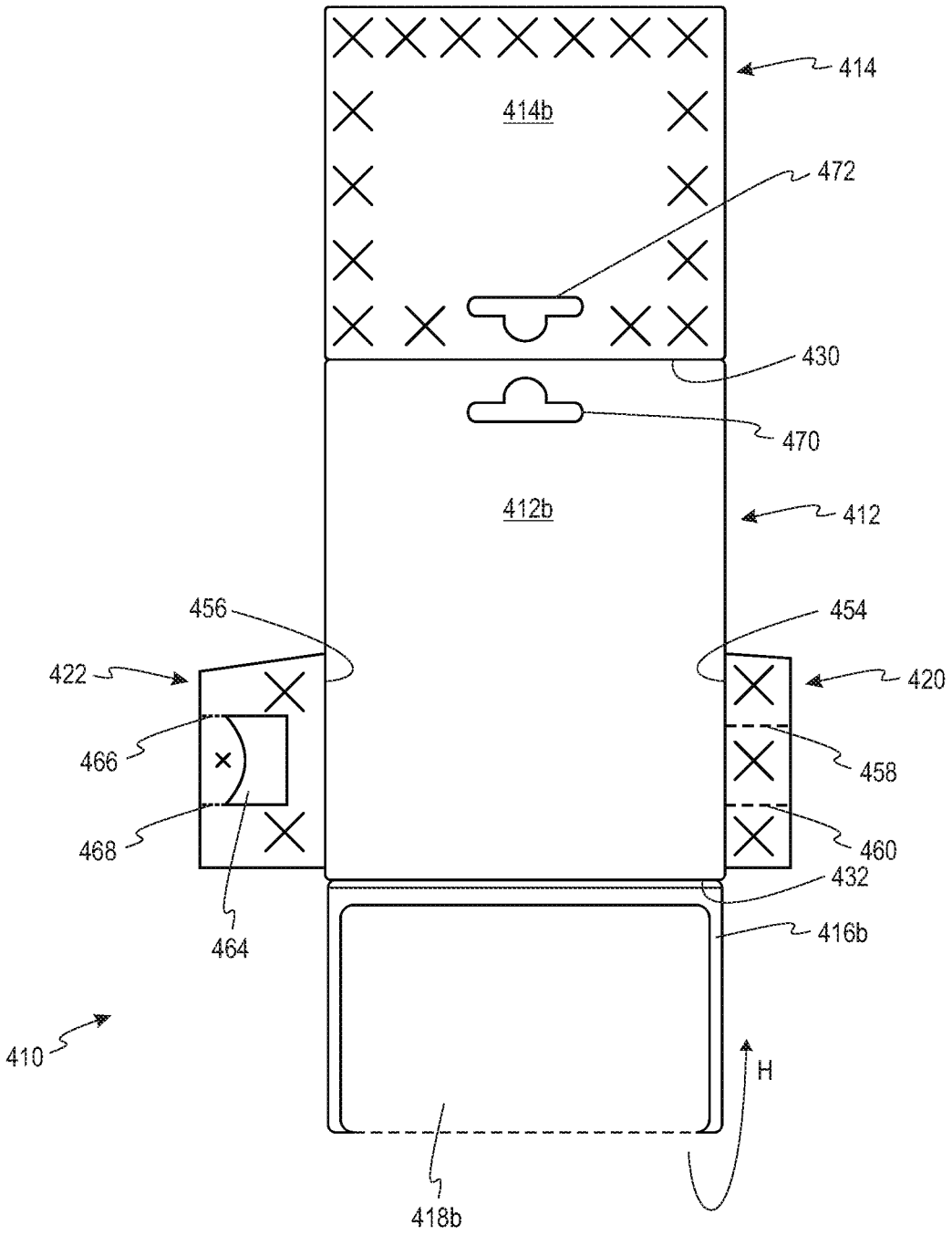
FIG. 7B is a top plan view of the blank of FIG. 7A after folding the attached first and second card panels onto a second back panel according to one embodiment of the present disclosure.

The attached card panels 418*a*, 418*b* of FIG. 7A are then folded onto the second back panel 416 via arrow G to the position shown in FIG. 7B. The attached card panels 418*a*, 418*b* are desirably unattached to the second back panel 416 to assist in easier removal of the card.

Figure 7C:
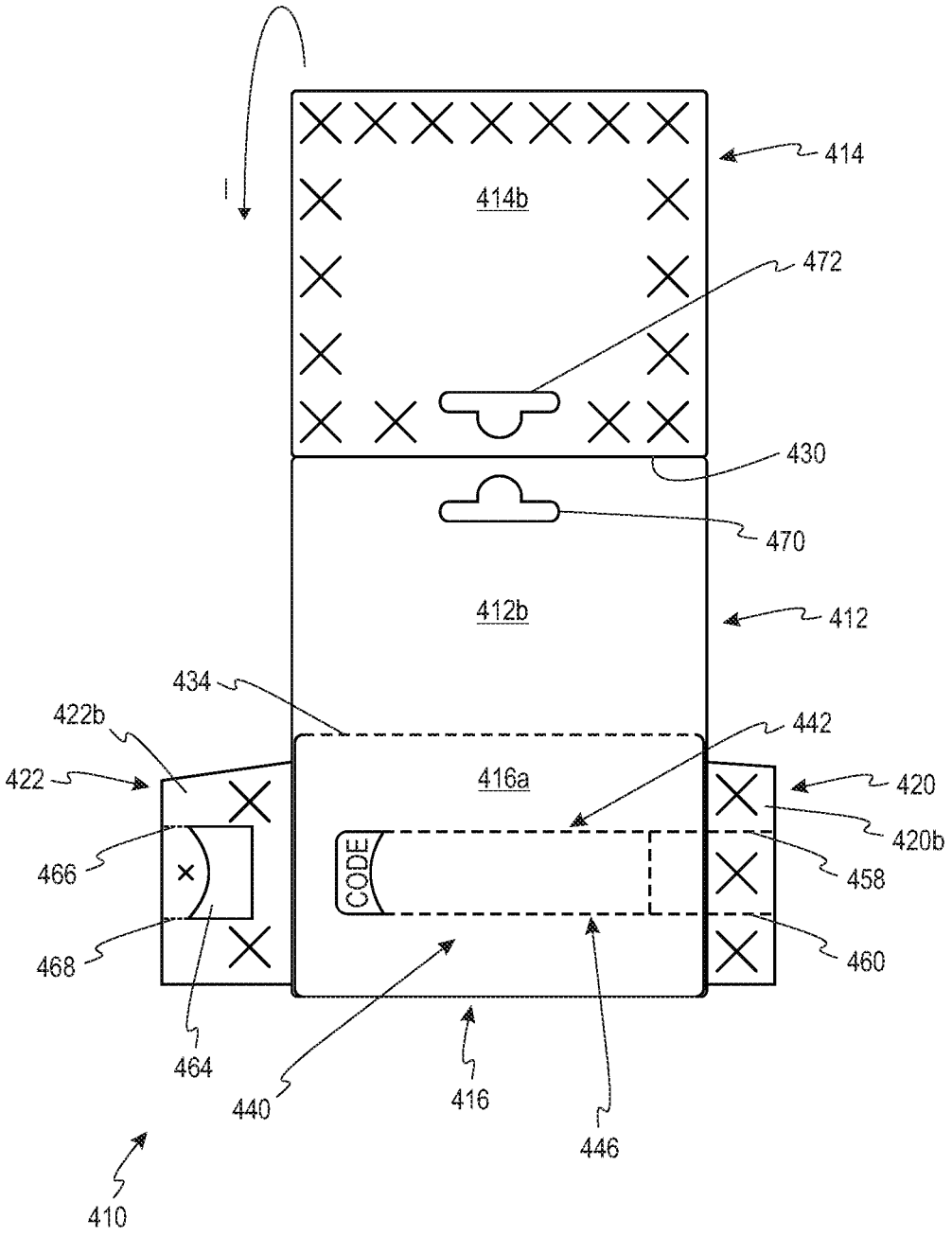
FIG. 7C is a top plan view of the blank of FIG. 7B after folding the attached first and second card panels and the second back panel onto a front panel according to one embodiment of the present disclosure.

The second back panel 416 and the attached card panels 418*a*, 418*b* are then folded over onto the front panel 412 via arrow H to the position of FIG. 7C. The second back panel 416 and the attached card panels 418*a*, 418*b* are typically not attached to the front panel 412, but may be removably adhered to the front panel. The first back panel 414 is then folded onto the front panel 412 and the second back panel 416 via arrow I to the position shown in FIG. 7D. The attachment of the first back panel 414 to the front panel 412 and the second back panel 416 may be formed in the area generally indicated by the periphery "X"s in the first back panel 414 of FIG. 7C. The adhesive may be located on at least one of the surfaces of the first back panel 414, the front panel 412 and the second back panel 416. It is contemplated that the attachment of the first back panel 414 to the front panel 412 and the second back panel 416 may be formed in areas other than that indicated by periphery "X"s in the first back panel 414. It is also contemplated that the adhesive may be located in a lesser or greater number of locations.

Figure 7D:
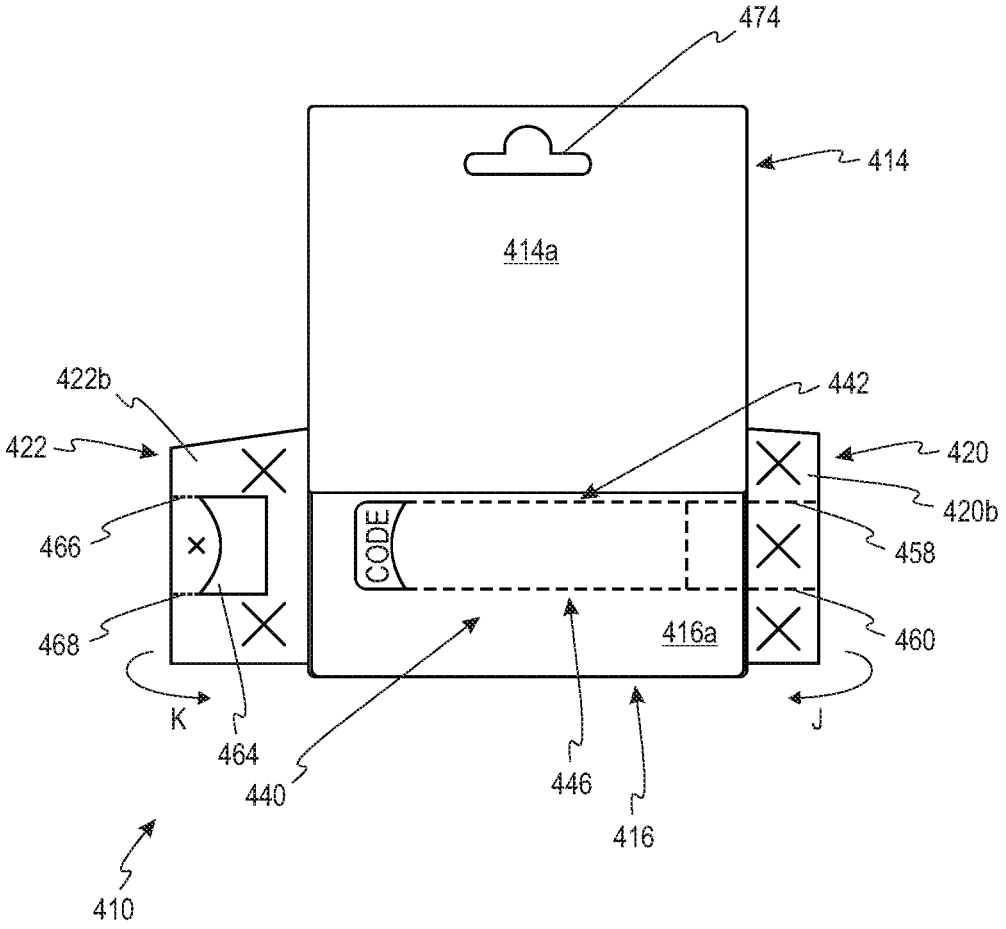
FIG. 7D is a top plan view of the blank of FIG. 7C after a first back panel has been folded and attached to the front panel and the second back panel according to one embodiment of the present disclosure.

After the first back panel 414 is attached to the front panel 412 and the second back panel 416, the first minor side flap 420 and the second minor side flap 422 are folded inwardly via arrows J, K of FIG. 7D and attached to the first back panel 414 and the second back panel 416. This position is shown in FIG. 7E.

Figure 7E:
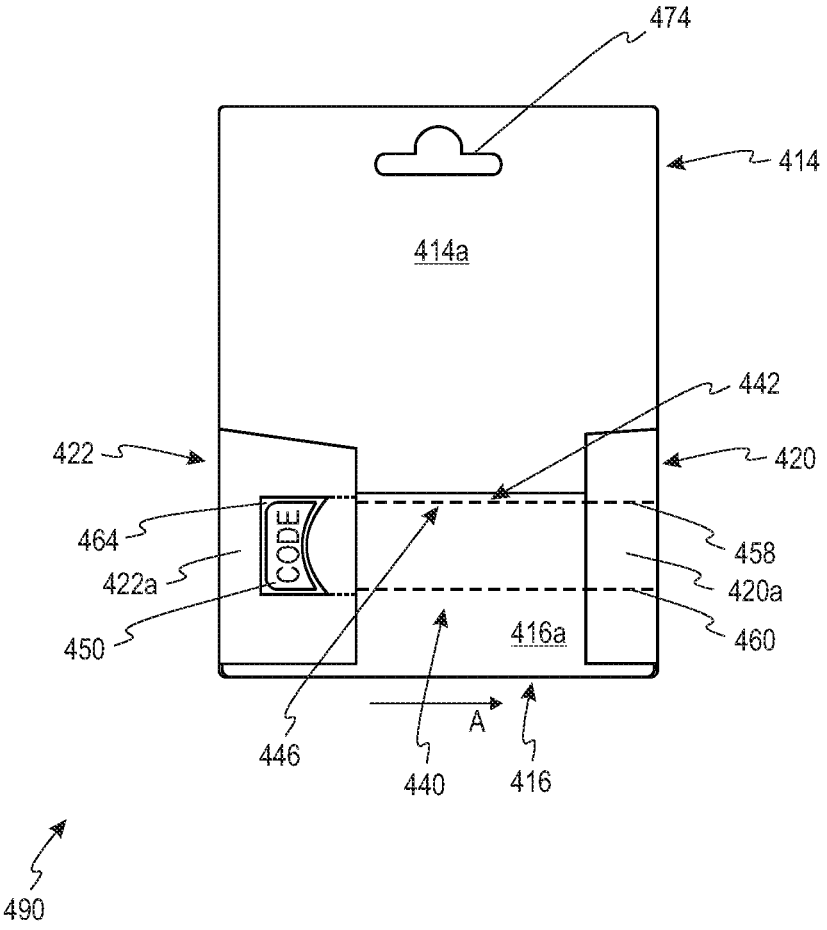
FIG. 7E is a top plan view of a carrier assembly in an unopened position after first and second minor side flaps in the blank of FIG. 7D have been folded inwardly and attached to the first back panel and the second back panel according to one embodiment of the present disclosure.
Figure 7F:
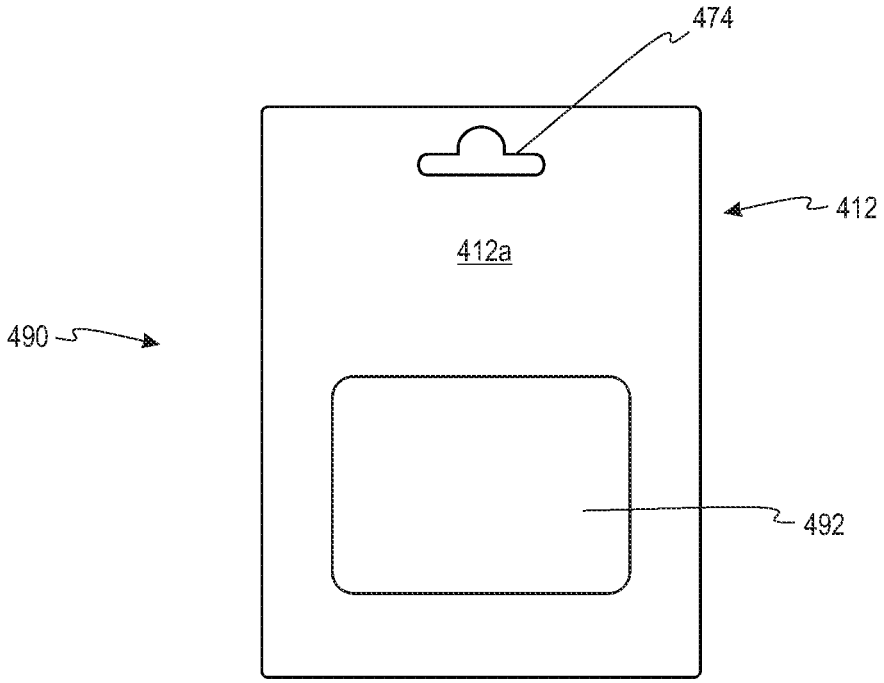
FIG. 7F is an opposing top plan view of the carrier assembly of FIG. 7E.

FIG. 7E shows a top plan view of the carrier assembly 490 in an unopened position, which is a back view of the carrier assembly. FIG. 7F shows an opposing top plan view of the carrier assembly 490 in an unopened position, which is a front view of the carrier assembly. FIG. 7F identifies an area 492 on the front side of the carrier assembly 490. This area 492 or other areas of the carrier assembly typically includes descriptions, graphics, advertising features, or other information thereon. Some additional information may include written or visual instructions on how to access the item of the carrier assemblies of the present invention.

Figure 7G:
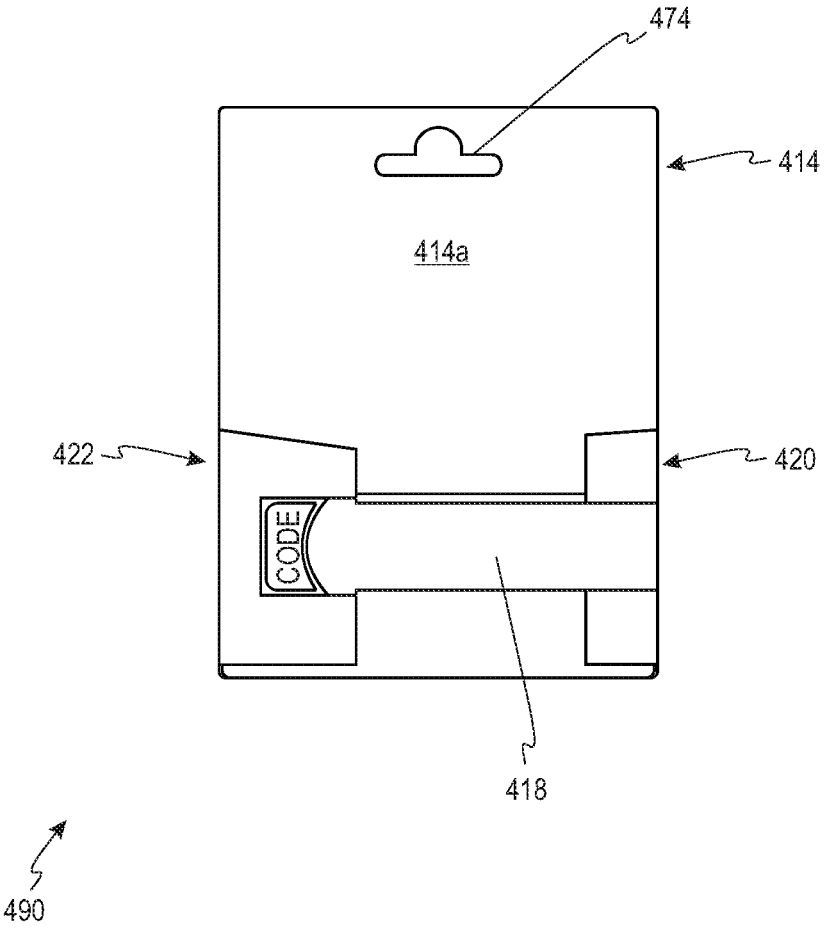
FIG. 7G is a top plan view of the carrier assembly of FIG. 7E in an opened position after removal of a tearable section according to one embodiment of the present disclosure.

Referring back to FIG. 7E, to gain access to a card 418 (attached card panel 418*a*, 418*b*) in the carrier assembly 490, a user grasps the end 440*a* of the tearable section 440 and pulls the tearable section 440 in the direction of arrow A. FIG. 7G shows the carrier assembly 490 after the tearable section 440 has been removed, which exposes a horizontally-extending portion of the card 418. It is contemplated that in other embodiments that the tearable section may not be removed fully removed. After the tearable section 440 has been partially or fully removable, this indicates to a purchaser that the information on the card 418 may have been accessed previously.

In one process, an individual purchases the card 418 that is included in the carrier assembly. During the purchase process, an employee will typically at least partially remove the tearable section 440 and activate the card by using the information exposed on the item.

The general dimensions of the carrier assembly in one non-limiting example are shown in FIG. 2D with carrier assembly 90. Specifically, the length L3 of the carrier assembly 90 is generally from about 3 inches to about 8 inches and, more specifically, from about 3 to about 5 inches. The height H1 of the carrier assembly 90 is generally from about 4 to about 12 inches and, more specifically, from about 4 to about 8 inches. It is contemplated that the other carrier assemblies would be the same or similar dimensions. It is noted that the dimensions of the carrier assembly must be a sufficient length and height to contain the desired item (e.g., card).

It is contemplated that different items may be included in the carrier assembly including, but not limited to, gift cards. It is contemplated, however, that other items may be used in the carrier assemblies of the present invention.

The thickness of the blanks to be used in forming the carrier assemblies is generally from about 8 mils to about 30 mils and, more specifically, from about 10 to about 15 mils.

The carrier assemblies of the embodiments described herein are typically manufactured using paperboard. The paperboard to form to each of the blanks is desirably formed from a single sheet. It is contemplated that the paperboard may be formed from multiple sheets.

It is to be understood that the principles of this invention could be applied to carrier assemblies made of other materials, such as corrugated paperboards, cardboard, corrugated fiberboard, non-corrugated fiberboard, solid-fiber board, polymeric materials, foldable metals and other foldable materials. Corrugated paperboard generally refers to a multilayer sheet material comprised of two sheets of liner bonded to a central corrugated layer of medium. It is contemplated that the materials for forming the different blanks may be made of different materials.

While the carrier assemblies of the embodiments described above include adhesive or glue for attaching various panels and flaps of the container assemblies, it is contemplated that any other suitable method of joining or attaching different panels and flaps as long as the item is desirably securely located within the carrier assembly and the item cannot be accessed without leaving evidence of the same.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A carrier assembly comprising:

a front panel, a first back panel, a second back panel, at least one card panel, a first minor side flap, and a second minor side flap, the front panel being connected to the first and second back panels via opposing fold lines, the at least one card panel being connected to one of the second back panel, the front panel or the first back panel, the second back panel forming a tearable section configured to be at least partially removed from a remainder of the second back panel via at least one frangible connection, the at least one card panel including information accessible after the tearable section is at least partially removed, the information of the at least one card panel including predetermined or variable monetary value, wherein the front panel, the first back panel, the second back panel, the first minor side flap, and the second minor side flap are folded and attached to one or more of the other panels so as to contain the at least one card panel, wherein the second minor side flap forms an aperture or cutout therein, the aperture or cutout of the second minor side flap being generally aligned with the aperture or cutout of the second back panel after being attached thereto.

2. The carrier assembly of claim 1, wherein the at least one card panel includes at least two card panels, the at least two card panels including a first card panel and a second card panel, the second card panel being adapted to fold onto and be fixedly connected to the first card panel to form a card.

3. The carrier assembly of claim 1, wherein the at least one card panel is connected to the second back panel.

4. The carrier assembly of claim 3, wherein the at least one card panel is connected to the second back panel via a frangible connection.

5. The carrier assembly of claim 1, wherein the first and second minor side flaps are attached to the front panel.

6. The carrier assembly of claim 1, wherein the second minor side flap includes a plurality of horizontal frangible connections that extend into the aperture or cutout of the second minor side flap.

7. The carrier assembly of claim 1, wherein the first minor side flap includes a plurality of horizontal frangible connections, the plurality of horizontal frangible connections being generally aligned with the tearable section after the first minor side flap is attached to the second back panel.

8. The carrier assembly of claim 1, wherein the predetermined or variable monetary value is in the form of a bar code or a QR code.

9. A carrier assembly configured to contain an item, comprising:

a front panel, a first back panel, a second back panel, a first minor side flap, and a second minor side flap, the front panel being connected to the first and second back panels via opposing fold lines, the second back panel forming a tearable section configured to be at least partially removed from the remainder of the second back panel via at least one frangible connection as to access information from the item, wherein the first back panel is folded inwardly and attached to the front panel, wherein the second back panel is folded inwardly onto the front panel, wherein the first minor side flap and the second minor side flap are adapted to fold inwardly and being attached so as to assist in containing an item, wherein the second minor side flap forms an aperture or cutout therein, the aperture or cutout of the second minor side flap being generally aligned with the aperture or cutout of the second back panel after being attached thereto.

10. The carrier assembly of claim 9, wherein the second back panel is attached to the front panel.

11. The carrier assembly of claim 9, wherein the first and second minor side flaps are attached to the front panel.

12. The carrier assembly of claim 9, wherein the second minor side flap includes a plurality of horizontal frangible connections that extend into the aperture or cutout of the second minor side flap.

13. The carrier assembly of claim 9, wherein the first minor side flap includes a plurality of horizontal frangible connections, the plurality of horizontal frangible connections being generally aligned with the tearable section after the first minor side flap is attached to the second back panel.

14. The carrier assembly of claim 9, wherein the item is a card.

* * * * *